US008290747B2

(12) United States Patent
Hamel et al.

(10) Patent No.: US 8,290,747 B2
(45) Date of Patent: Oct. 16, 2012

(54) STRUCTURAL DAMAGE DETECTION AND ANALYSIS SYSTEM

(75) Inventors: Michael J. Hamel, Essex Junction, VT (US); Steven W. Arms, Williston, VT (US)

(73) Assignee: Microstrain, Inc., Williston, VT (US)

( * ) Notice: Subject to any disclaimer, the term of this patent is extended or adjusted under 35 U.S.C. 154(b) by 1262 days.

(21) Appl. No.: 11/585,059

(22) Filed: Oct. 23, 2006

(65) Prior Publication Data

US 2007/0144396 A1 Jun. 28, 2007

Related U.S. Application Data

(60) Provisional application No. 60/729,166, filed on Oct. 21, 2005, provisional application No. 60/753,481, filed on Dec. 22, 2005, provisional application No. 60/739,976, filed on Nov. 23, 2005, provisional application No. 60/753,679, filed on Dec. 22, 2005, provisional application No. 60/762,632, filed on Jan. 26, 2006.

(51) Int. Cl.

| | |
|---|---|
| ***G01B 5/00*** | (2006.01) |
| ***G01L 1/00*** | (2006.01) |
| ***G01L 3/00*** | (2006.01) |
| ***G01L 5/00*** | (2006.01) |
| ***G06F 17/40*** | (2006.01) |

(52) U.S. Cl. ..... 702/187; 702/33; 702/42; 702/189

(58) Field of Classification Search ..... 702/33, 702/42, 187, 189

See application file for complete search history.

(56) References Cited

U.S. PATENT DOCUMENTS

| | | | | |
|---|---|---|---|---|
| 4,223,319 | A | 9/1980 | Engdahl | |
| RE34,974 | E * | 6/1995 | Terashima | 365/206 |
| 5,512,748 | A * | 4/1996 | Hanson | 250/332 |
| 5,592,173 | A * | 1/1997 | Lau et al. | 342/357.12 |
| 6,407,483 | B1 | 6/2002 | Nunuparov | |
| 6,427,129 | B1 * | 7/2002 | Lalla | 702/88 |
| 6,433,629 | B2 * | 8/2002 | Hamel et al. | 327/588 |
| 6,529,127 | B2 | 3/2003 | Townsend | |
| 6,580,177 | B1 | 6/2003 | Hagood | |
| 6,588,282 | B2 | 7/2003 | Arms | |
| 6,643,968 | B2 | 11/2003 | Glock | |
| 6,756,930 | B1 | 6/2004 | Nunuparov | |
| 6,834,436 | B2 | 12/2004 | Townsend | |
| 6,901,654 | B2 | 6/2005 | Arms | |
| 7,006,946 | B1 | 2/2006 | Tyndall | |
| 7,081,693 | B2 | 7/2006 | Hamel | |

(Continued)

OTHER PUBLICATIONS

Discenzo et al, "Intelligent Sensor Nodes Enable a New Generation of Machinery Diagnostics and Prognostics, New Frontiers in Integrated Diagnostics and Prognostics,"55th Meeting of the Society for Machinery Failure Prevention Technology, Apr. 2001, Virginia Beach.

(Continued)

*Primary Examiner* — Janet Suglo
(74) *Attorney, Agent, or Firm* — James Marc Leas

(57) ABSTRACT

A system for electronically recording an event that provides mechanical energy to a structure includes the structure and an event sensing and recording node. The event sensing and recording node is mounted on the structure and includes a sensor and a first electronic memory. The sensor includes a device for converting the mechanical energy into an electrical signal. The first electronic memory uses energy derived from the electrical signal for electronically recording the event. All energy for sensing the event and recording the event in the first electronic memory is derived from the mechanical energy.

124 Claims, 17 Drawing Sheets

U.S. PATENT DOCUMENTS

| | | | | |
|---|---|---|---|---|
| 7,142,959 | B2 * | 11/2006 | Oesterling et al. | 701/29 |
| 7,143,004 | B2 | 11/2006 | Townsend | |
| 2001/0037180 | A1 * | 11/2001 | Komura et al. | 702/56 |
| 2002/0024450 | A1 | 2/2002 | Arms | |
| 2002/0064096 | A1 * | 5/2002 | Ukita et al. | 368/66 |
| 2002/0174588 | A1 | 11/2002 | Danner | |
| 2003/0061753 | A1 | 4/2003 | Glock | |
| 2003/0234730 | A1 | 12/2003 | Arms | |
| 2004/0010382 | A1 * | 1/2004 | Lung et al. | 702/34 |
| 2004/0078662 | A1 * | 4/2004 | Hamel et al. | 714/22 |
| 2004/0103139 | A1 * | 5/2004 | Hubbard et al. | 709/201 |
| 2004/0200109 | A1 | 10/2004 | Vasquez | |
| 2005/0017602 | A1 | 1/2005 | Hamel | |
| 2005/0087019 | A1 | 4/2005 | Face | |
| 2005/0088059 | A1 | 4/2005 | Ohkubo | |
| 2005/0155420 | A1 | 7/2005 | Johnson | |
| 2005/0200002 | A1 * | 9/2005 | Yamashita | 257/723 |
| 2005/0210340 | A1 | 9/2005 | Arms | |
| 2006/0006991 | A1 | 1/2006 | Tyndall | |
| 2006/0079354 | A1 | 4/2006 | Lammer | |
| 2006/0213278 | A1 | 9/2006 | Townsend | |
| 2006/0254365 | A1 | 11/2006 | Hamel | |

OTHER PUBLICATIONS

Paradiso, Starner, "Energy Scavenging for Mobile and Wireless Electronics," Pervasive Computing, IEEE CS and IEEE ComSoc, vol. 1536-1268, pp18-26, 2005.

Product Literature: "Series 2000 Magnetic Sensor," HID Corporation, Universal Security Instruments, www.VSiIndia.com.

Discenzo et al, "Intelligent Sensor Nodes Enable a New Generation of Machinery Diagnostics and Prognostics, New Frontiers in Integrated Diagnostics and Prognostics,", 2001.

55th Meeting of the Society for Machinery Failure Prevention Technology, Apr. 2001, Virginia Beach.

Weiss, "An Advanced Strain Level Counter for Monitoring Aircraft Fatigue," Instrument Society of America, ASI 72212, pp. 105-108, 1972.

Roundy et al, "Energy Scavenging for Wireless Sensor Networks with Special Focus on Vibrations," Kluwer Academic Press, 2004.

Paradiso, Starner, "Energy Scavenging for Mobile and Wireless Electronics," Pervasive Computing, IEEE CS and IEEE ComSoc, vol. 1536-1268, pp. 18-26, 2005.

Vasquez et al, "A Soft Magnetic Wire for Sensor Applications," J. Phys. D: Appl. Phys. 29 (1996) 939-949.

Ryu et al, "Magnetoelectric Effect in Composites of Magnetostrictive and Piezoelectric Materials," Journal of Electroceramics, 8, pp. 107-119, 2002.

Neubert, "Instrument Transducers," Second Edition, Oxford University Press, chapter 4.5 Piezoelectric transducers, pp. 252-290, 1975.

Product Literature: "Series 2000 Magnetic Sensor," HID Corporation, Universal Security Instruments, www.VSiIndia.com, 2000.

Product Literature: "Tiny Serial Digital Thermal Sensor," Microchip Technology Inc., Chandler, AZ, 2002.

Arms et al, "Power Management for Energy Harvesting Wireless Sensors," SPIE International Symposium on Smart Structures & Materials, Mar. 9, 2005, San Diego, CA.

* cited by examiner

Zener Diode V-I Curve

Event Triggered Burst Sampling

Periodic Polled Sampling

STRUCTURAL DAMAGE DETECTION AND ANALYSIS SYSTEM

RELATED APPLICATIONS AND PRIORITY

This application claims priority of Provisional Patent Application 60/729,166, filed Oct. 21, 2005 incorporated herein by reference.

This application is related to the following commonly assigned patent applications:

"Method of Fabricating a Coil and Clamp for Variable Reluctance Transducer," U.S. Pat. No. 6,901,654, to S. W. Arms et al., filed Jan. 10, 2001 ("the '654 patent").

"Peak Strain Detection Linear Displacement Sensor System for Smart Structures," U.S. Pat. No. 6,588,282, to S. W. Arms, filed Mar. 1, 1999 ("the '282 patent").

"Robotic system for powering and interrogating sensors," U.S. patent application Ser. No. 10/379,224 to S. W. Arms et al, filed Mar. 5, 2003 ("the '224 application").

"Wireless Vibrating Strain Gauge for Smart Civil Structures," U.S. patent application Ser. No. 11/431,194 to M. Hamel, filed May 10, 2006 ("the '194 application").

"Sensor Powered Event Logger," U.S. Provisional Patent Application No. 60/753,481 to D. L. Churchill et al, filed Dec. 22, 2005, ("the '481 application").

"Slotted Bean Piezoelectric Composite," U.S. Provisional Patent Application No. 60/739,976 to D. L. Churchill, filed Nov. 23, 2005, ("the '976 application").

"Method for Integrating an energy harvesting circuit into a PZ element's electrodes," U.S. Provisional Patent Application No. 60/753,679 to D. L. Churchill et al, filed Dec. 22, 2005, ("the '679 application").

"Method for Integrating an energy harvesting circuit into a PZ element's electrodes," U.S. Provisional Patent Application No. 60/762,632 to D. L. Churchill et al, filed Jan. 26, 2006, ("the '632 application").

"Structural Damage Detection and Analysis System," U.S. Provisional Patent Application No. 60/729,166 to M. Hamel, filed Oct. 21, 2005, ("the '166 application").

"Energy Harvesting for Wireless Sensor Operation and Data Transmission," U.S. Pat. No. 7,081,693 to M. Hamel et al., filed Mar. 5, 2003 ("the '693 patent").

"Shaft Mounted Energy Harvesting for Wireless Sensor Operation and Data Transmission," U.S. patent application Ser. No. 10/769,642 to S. W. Arms et al., filed Jan. 31, 2004 ("the '642 application").

"Wireless Sensor System," U.S. patent application Ser. No. 11/084,541 to C. P. Townsend et al., filed Mar. 18, 2005 ("the '541 application").

"Strain Gauge with Moisture Barrier and Self-Testing Circuit ," U.S. patent application Ser. No. 11/091,244, to S.W. Arms et al., filed Mar. 28, 2005 ("the '244 application").

"Miniature Stimulating and Sensing System," U.S. patent application Ser. No. 11/368,731 to J. C. Robb et al., filed Mar. 6, 2006 ("the '731 application").

"Miniaturized Wireless Inertial Sensing System," U.S. patent application Ser. No. 11/446,637 to D. L. Churchill et al., filed Jun. 5, 2006 ("the '637 application").

"Data Collection and Storage Device," U.S. patent application Ser. No. 09/731,066 to C. P. Townsend et al., filed Dec. 6, 2000 ("the '066 application").

"Circuit for Compensation for Time Variation of Temperature in an Inductive Sensor," Reissue U.S. patent application Ser. No. 11/320,559 to C. P. Townsend et al., filed Dec. 28, 2005 ("the '559 application").

"System for Remote Powering and Communication with a Network of Addressable Multichannel Sensing Modules," U.S. Pat. No. 6,529,127 C. P. Townsend et al., filed Jul. 11, 1998 ("the '127 patent").

"Solid State Orientation Sensor with 360 Degree Measurement Capability," U.S. patent application Ser. No. 10/447,384 to C. P. Townsend et al., filed May 2003 ("the '384 application").

"Posture and Body Movement Measuring System," U.S. Pat. 6,834,436 to C. P. Townsend et al., filed Feb. 23, 2002 ("the '436 patent").

"Energy Harvesting, Wireless Structural Health Monitoring System," U.S. patent application Ser. No. 11/518,777, to Steven W. Arms, et al, filed Sep. 11, 2006, ("the '777 application").

All of the above listed patents and patent applications are incorporated herein by reference.

FIELD

This patent application generally relates to a system for sensing an energetic event. It also relates to structural health monitoring and health usage monitoring in systems in which damaging events may occur. It also relates to sensor devices and to networks of sensor devices for detecting, counting, or measuring energetic and damaging events. More particularly it relates to an energy harvesting system for providing power for monitoring energetic or damaging events, for determining structural health, and for providing power for transmitting data wirelessly. Even more particularly, it relates to a monitor for a gun.

BACKGROUND

Structures, such as a bridges, buildings, heavy equipment, aircraft, and guns are subject to stresses from energetic events and damaging events as well as from ordinary use. An energetic event may be the firing of a gun, such as a handgun, a rifle, an aircraft gun, artillery, or a rocket launcher. A damaging event may be a collision, an explosion, an earthquake, or a fire. A damaging event may also be caused when a structure or vehicle is hit by a bullet, missile, or shrapnel. A damaging event can also be caused by excessive loading during otherwise ordinary use. Damage can accumulate over time from repeated use, particularly repeated use with excessive loading. Damage can also result over time from corrosion, thermal cycling, or humidity during otherwise ordinary use. Damage can also occur from degradation produced by an excessive number of ordinary uses.

Schemes to test structures for damage have been proposed, as described in the '731 application. But no completely passive scheme has been in place on structures to quickly sense the event that caused the damage or to electrically record the damaging event almost immediately after it occurs.

Sensors, signal conditioners, processors, and digital wireless radio frequency (RF) links continue to become smaller, consume less power, and include higher levels of integration. The combination of these elements can provide sensing, acquisition, storage, and reporting functions in very small packages. Such sensing devices have been linked in wireless networks as described in the '127, patent and in the '9224, '194, '481, '541, '731, '637, '066, and '436 applications.

Networks of intelligent sensors have been described in a paper, "Intelligent Sensor Nodes Enable a New Generation of Machinery Diagnostics and Prognostics, New Frontiers in Integrated Diagnostics and Prognostics," by F. M. Discenzo, K. A. Loparo, D. Chung, A. Twarowsk, 55th Meeting of the Society for Machinery Failure Prevention Technology, April, 2001, Virginia Beach.

Wireless sensors have the advantage of eliminating wiring installation expense and weight as well as connector reliability problems. However, wireless sensors still require power in order to operate. In some cases, sensors may be hardwired to a vehicle's power system. The wiring required for power defeats the advantages of wireless sensors and may be unacceptable for many applications. In addition, if a power outage occurs, critical data may be lost, at least during the time of the power outage.

To counteract anticipating degradation with each firing, military aircraft guns are ordinarily scheduled for tear-down and inspection every 15,000 rounds or every 18 months, whichever occurs first. Schemes have been proposed to count the number of rounds fired by a particular gun while in ordinary use, such as described in U.S. Patent Application US2003/0061753 to Glock filed Sep. 23, 2003, and US2004/0200109 to Vasquez, filed Feb. 6, 2004. However, these schemes have required the use of batteries, which themselves require maintenance, to provide power for their detecting, data storage, and communication electronics.

Similarly, most prior wireless structural monitoring systems have relied on continuous power supplied by batteries. For example, a paper "An Advanced Strain Level Counter for Monitoring Aircraft Fatigue", by Weiss, Instrument Society of America, ASI 72212, 1972, pages 105-108, 1972, described a battery powered inductive strain measurement system which measured and counted strain levels for aircraft fatigue. The disadvantage of traditional batteries, however, is that they become depleted and must be periodically replaced or recharged. This additional maintenance task adds cost and limits use to accessible locations.

Given the limitations of battery power, there has been a need for systems which can operate effectively using alternative power sources. Energy harvesting from vibrating machinery and rotating structures to provide power for such sensing devices and for wireless networks of sensors and/or actuators has been described in the commonly assigned '693 patent and in the '976, '679, '632, '642, and '731 applications.

A paper, "Energy Scavenging for Wireless Sensor Networks with Special Focus on Vibrations," by S. Roundy et al., Kluwer Academic Press, 2004, and a paper "Energy Scavenging for Mobile and Wireless Electronics," Pervasive Computing, by J. A. Paradiso & T. Starner, IEEE CS and IEEE ComSoc, Vol 1536-1268, pp 18-26, 2005, describe various strategies for harvesting or scavenging energy from the environment.

U.S. Pat. No. 6,407,483 to Nunuparov, filed with the PCT on Oct. 29, 1998 and in the U.S. on Apr. 27, 2000, U.S. Patent Application US 2005/0087019, to Face, filed Oct. 25, 2004, the '693 patent, the '642 application, and the '777 application describe systems that harvest ambient energy for providing electrical power. These systems can provide power autonomously because they do not require traditional battery maintenance.

However, these energy harvesting systems have not been optimized for use on structures, such as aircraft, containers, and weapons, for use in networks, or for use in monitoring structures and equipment that may be subject to specific events, such as a damaging event, or the normal operation of an apparatus, such as the firing of a gun or the opening of a door. Thus, an improved system for monitoring is needed that can effectively use energy of an event for recording information about the event, and this solution is provided by this patent application.

SUMMARY

One aspect of the present patent application is a system for electronically recording an event that provides mechanical energy to a structure. The system includes the structure and an event sensing and recording node. The event sensing and recording node is mounted on the structure and includes a sensor and a first electronic memory. The sensor includes a device for converting the mechanical energy into an electrical signal. The first electronic memory uses energy derived from the electrical signal for electronically recording the event. All energy for sensing the event and recording the event in the first electronic memory is derived from the mechanical energy.

Another aspect of the present patent application is a system comprising a first energy harvesting device and a second energy harvesting device. The first energy harvesting device includes a device for converting mechanical energy into electricity. The second energy harvesting device includes a device for converting electromagnetic radiation energy into electricity.

Another aspect of the present patent application is a sensing and memory device, comprising a piezoelectric transducer and a memory. A signal from the piezoelectric transducer that exceeds a threshold changes state of the memory. All energy for changing state of the memory is derived from the signal.

Another aspect of the present patent application is a method of sensing and recording a potentially damaging event and a method of using data derived from the recording of the potentially damaging event. The method includes providing an event sensing and recording node on a structure. The event sensing and recording node includes a device for converting mechanical energy of the event into an electrical signal. When an event occurs, this device senses the event and converts mechanical energy of the event into an electrical signal. Then the event sensing and recording node records data regarding the event in an electronic memory using energy in the electrical signal. All energy for recording the event in the electronic memory is derived from the mechanical energy. Data in the electronic memory is then communicated and the structure is inspected based on the data recorded in the electronic memory that was communicated.

BRIEF DESCRIPTION OF THE DRAWINGS

The foregoing will be apparent from the following detailed description as illustrated in the accompanying drawings, in which:

FIG. 4*a* is a side view of a hand gun with a piezoelectric sensor or an array of piezoelectric sensors and circuits of FIG. 1 for sensing firing of the hand gun;

DETAILED DESCRIPTION

In one embodiment of the present patent application, the energy of an event is used to log data about the event. The event can be non-periodic, such as a structure being struck by an object. The event can result from the occasional operation of an apparatus, such as the firing of a gun or the opening of a door or container. It can be a potentially damaging event, such as foam striking a tile of a spacecraft or a bullet striking the skin of an aircraft. In addition to the event being recorded, the magnitude of the event, the date and time, and the location of the event can be recorded. Then, the system described in the present application can provide characterization of the damage. Advantageously, the system uses little energy for recording the event and it can harvest that energy from the event itself. In one embodiment, substantial portions of the electronics are kept in sleep mode during a large portion of the time so little energy is consumed for its operation, and battery maintenance is substantially reduced or eliminated.

Figure 1:
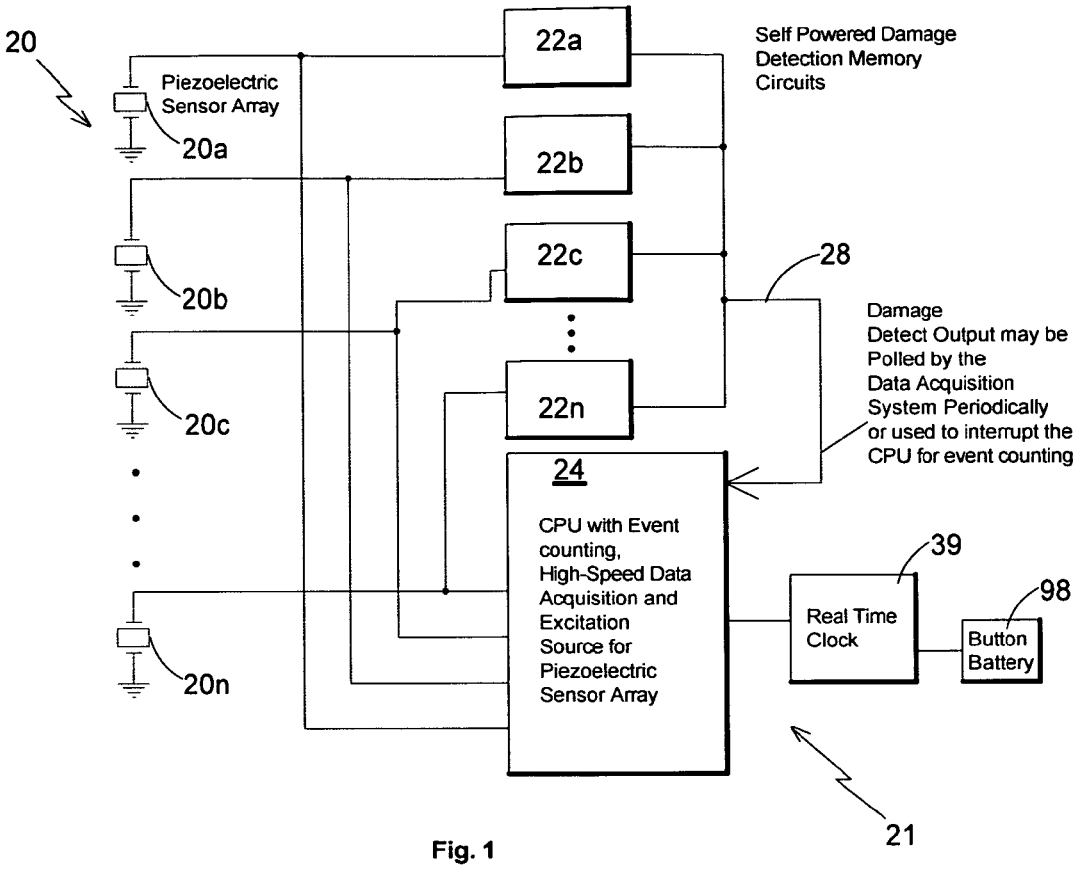
FIG. 1 is a block diagram of an array of sensors, a sensing circuit and a CPU, in which the sensing circuit records sensor data and uses energy of the sensor to power the recording.

The circuit topology shown in FIG. 1 provides array 20 of piezoelectric sensors connected to electrical support circuits 21, including self-powered event logging circuit 22 in parallel with CPU 24. CPU 24 provides for such actions, such as storing data in a non-volatile memory, incrementing a memory for counting events, analyzing data, and providing electrical signals to the piezoelectric devices, now acting as actuators, to provide acoustic signals to the structure for further structural analysis, as described in the '731 application.

Event logging circuit 22 is "self-powered" because electricity generated by one of the piezoelectric sensors of array 20, as it senses an event, is the electricity used for logging that event in a memory location of event logging circuit 22. While another source of power may be needed for circuits that read that memory or that take further action based on data in that memory, the event logging circuit itself is self-powered since the event it is detecting is the sole source of energy for operation of the event logging circuit to log the event in its memory. The present inventors have also found a way to arrange these circuits to provide a self-powered recording indicating the magnitude of the event.

Figure 2E:
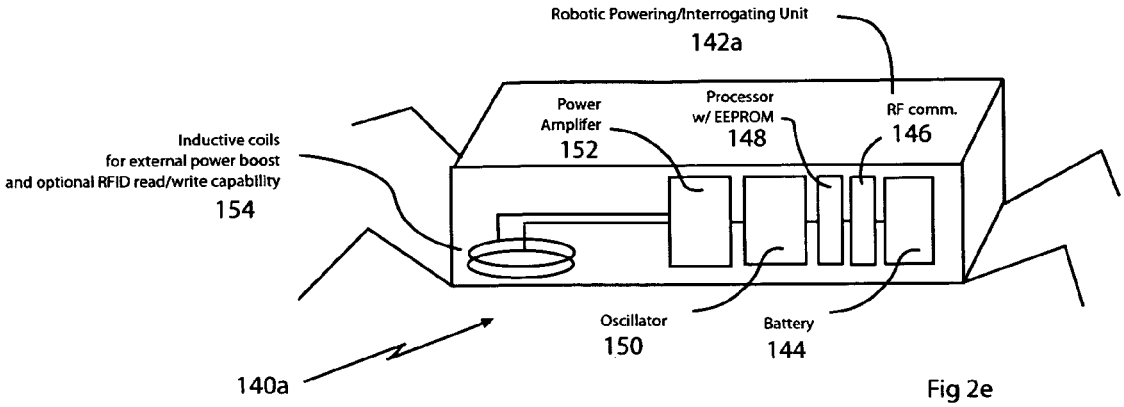
FIG. 2*e* is a three dimensional view of a mobile robot that can move along the surface of the shuttle for providing power and bidirectionally communicating with circuits that are embedded in or under the tiles of FIG. 2*b;*
Figure 2A:
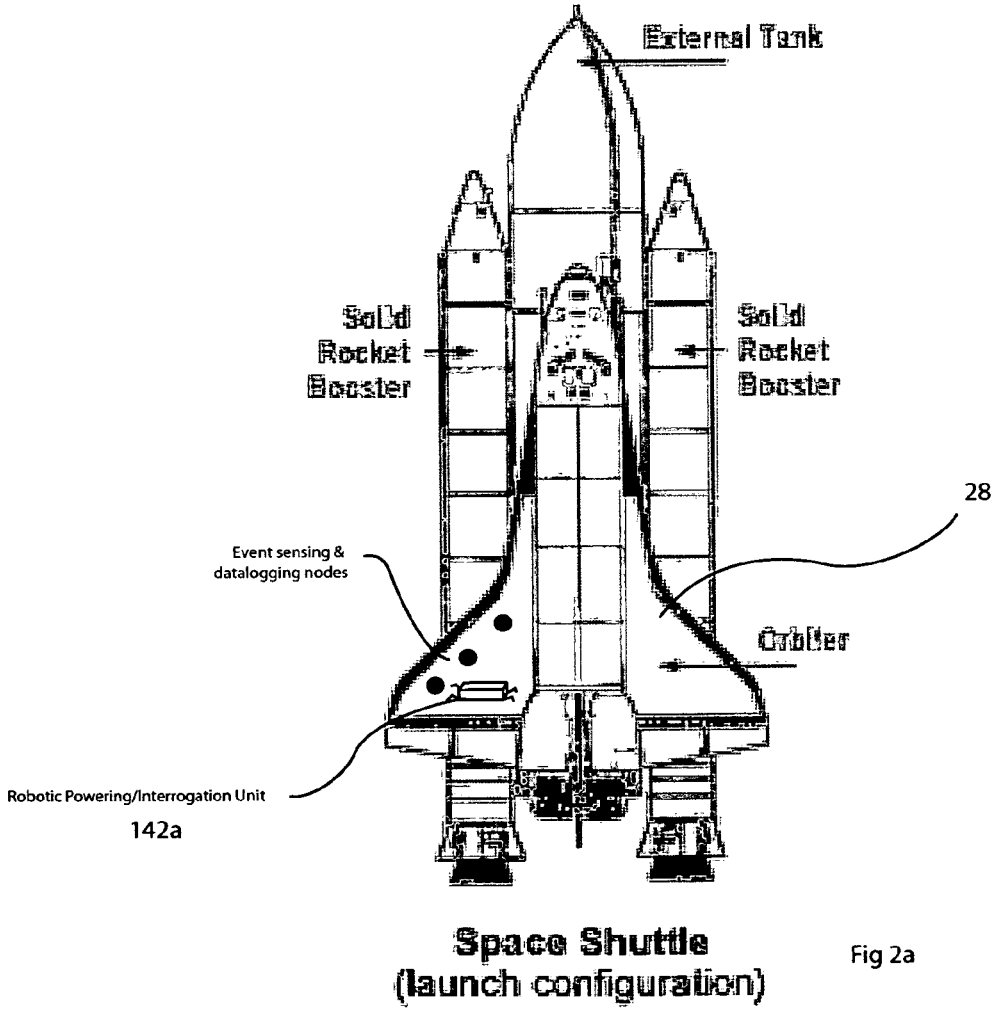
FIG. 2*a* is a top view of a space shuttle with the array and circuits of FIG. 1 for sensing damage to tiles.
Figure 2D:
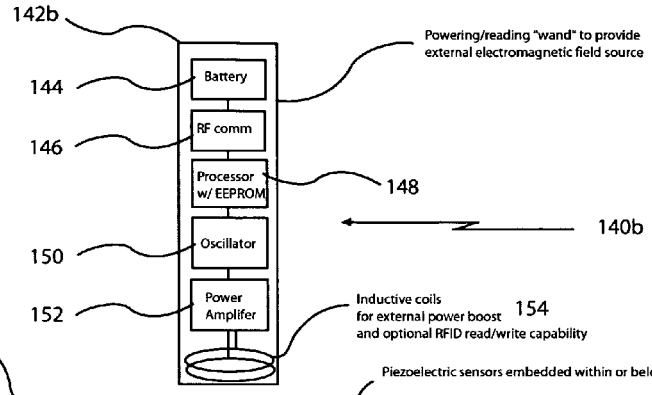
FIG. 2*d* is a side view of a reader for providing power and bidirectionally communicating with circuits that are provided embedded in or under the tiles of FIG. 2*b* that are provided on the space shuttle of FIG. 2*a;*
Figure 2B:
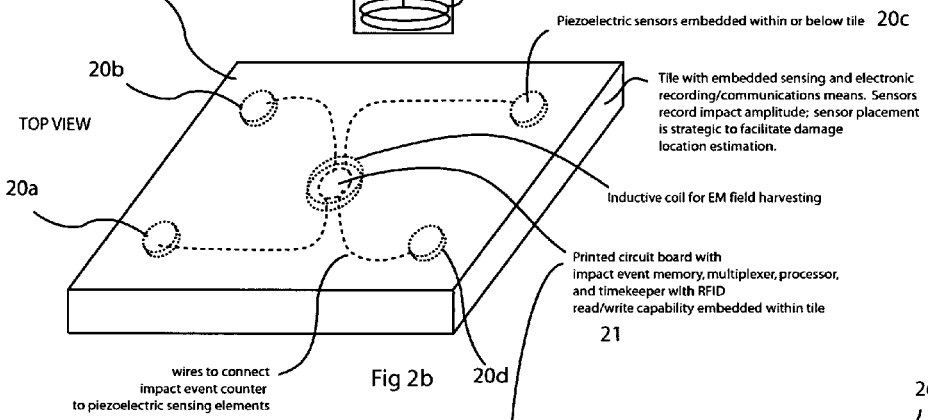
FIG. 2*b* is a three dimensional view of tile for the space shuttle of FIG. 2*a* showing one arrangement of the array and circuits of FIG. 1 as embedded under the tile.
Figure 2C:
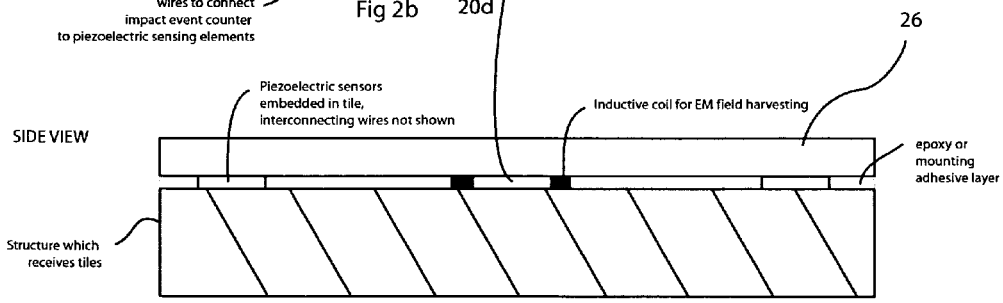
FIG. 2*c* is a cross sectional view of the tile of FIG. 2*b* showing the tile, the inductive coil, and the epoxy or adhesive layer for mounting to the underlying structure that receives tiles.
Figure 3A:
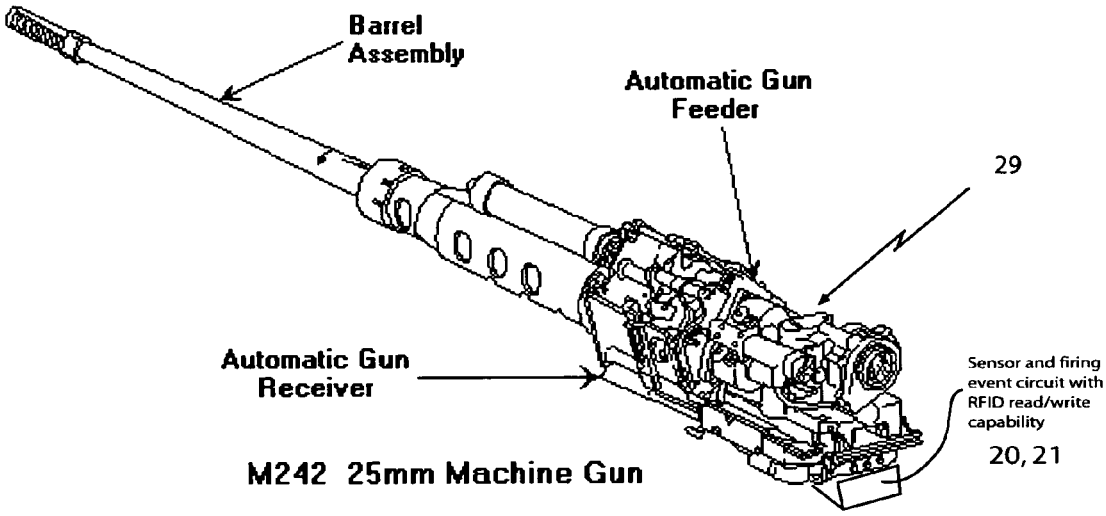
FIG. 3*a* is a three dimensional view of a 25 mm machine gun with a piezoelectric sensor or an array of piezoelectric sensors and circuits of FIG. 1 for sensing firing of the gun.
Figure 3B:
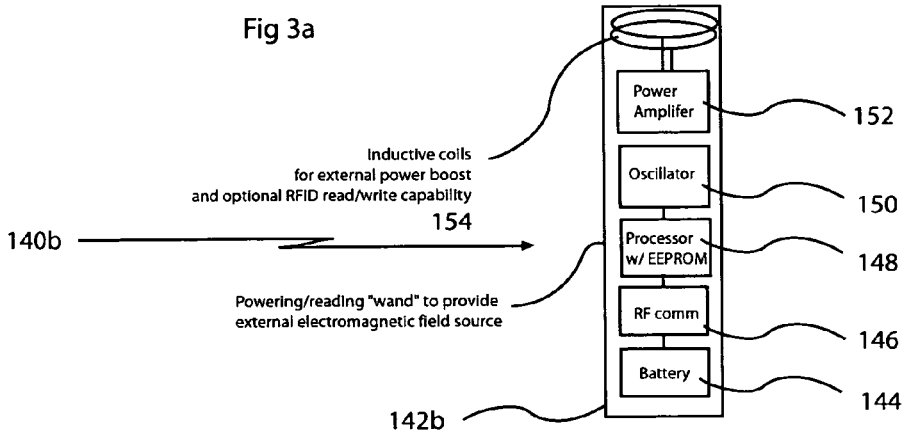
FIG. 3*b* is a side view of a reader for providing power and bidirectionally communicating with circuits that are provided on the machine gun of FIG. 3*a;*
Figure 4B:
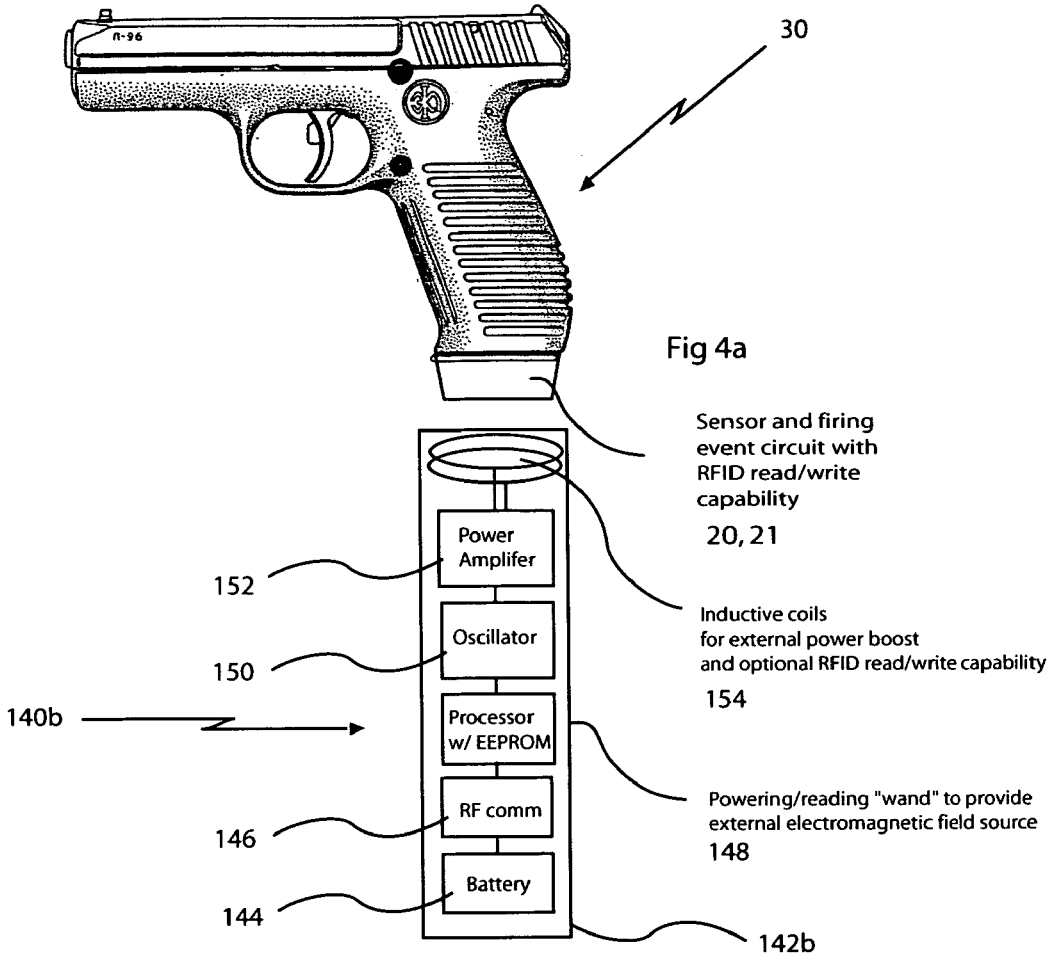
FIG. 4*b* is a side view of a reader for providing power and bidirectionally communicating with circuits that are provided on the hand gun of FIG. 3*a;*

Array 20 and its electrical support circuits 21 may, for example, be provided on tile 26 mounted on space shuttle 28, as shown in FIGS. 2*a*, 2*b*, 2*c*, to detect a damaging event. A single piezoelectric sensor or array 20 of piezoelectric sensors and electrical support circuit 21 can similarly be providing on a component of machine gun 29 or handgun 30, as shown in FIGS. 3*a* and 4*a*, to record data about normal operation of either type of gun. Such a sensor or array of sensors can also be provided on a structural member of any other vehicle, structure, or machine, and can also be provided on helmets, clothing, or body armor, or connected directly to surface features or implants in living things to detect events that cause generation of sufficient electricity by a piezoelectric sensor or at least one of the piezoelectric sensors in array 20 to cause logging of that event in memory.

Figure 5A:
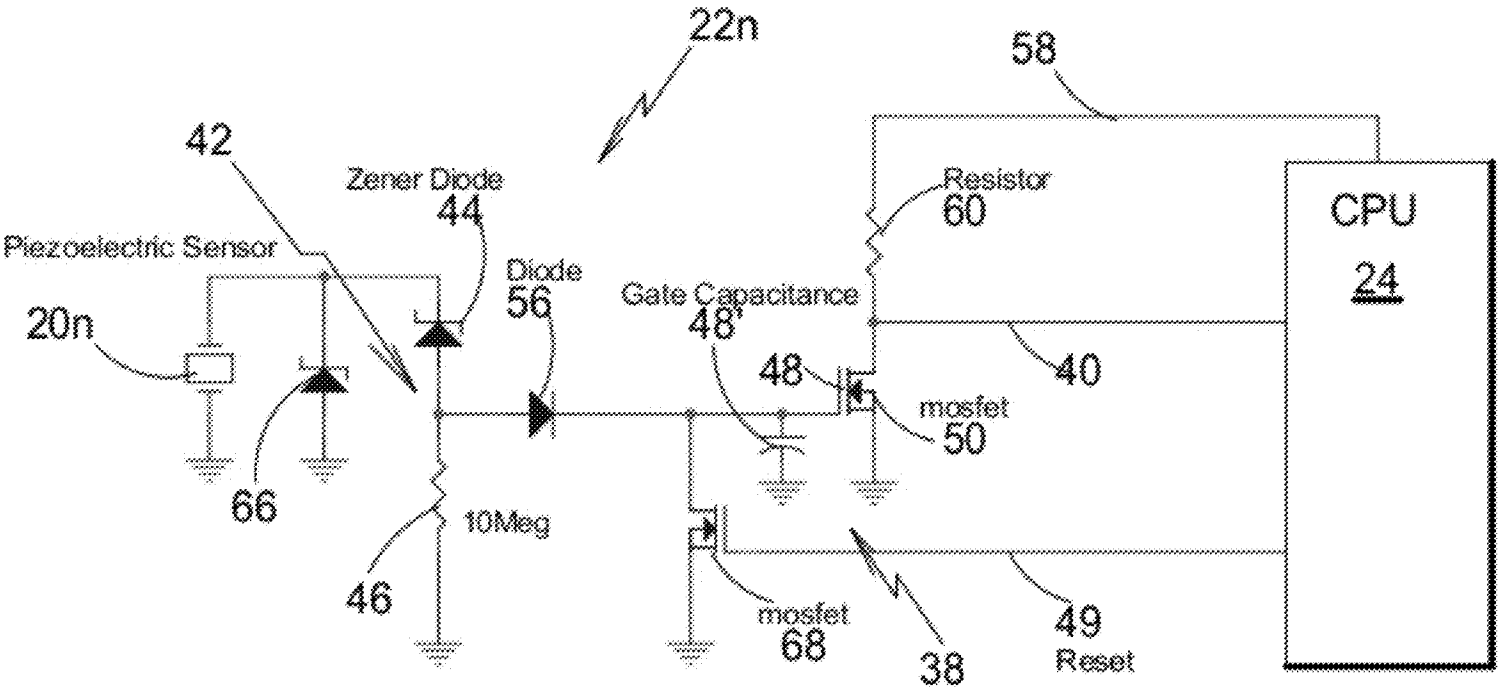
FIG. 5*a* is a schematic diagram of a piezoelectric sensor and a circuit that records sensor data and uses energy of the sensor to power the recording.
Figure 5B:
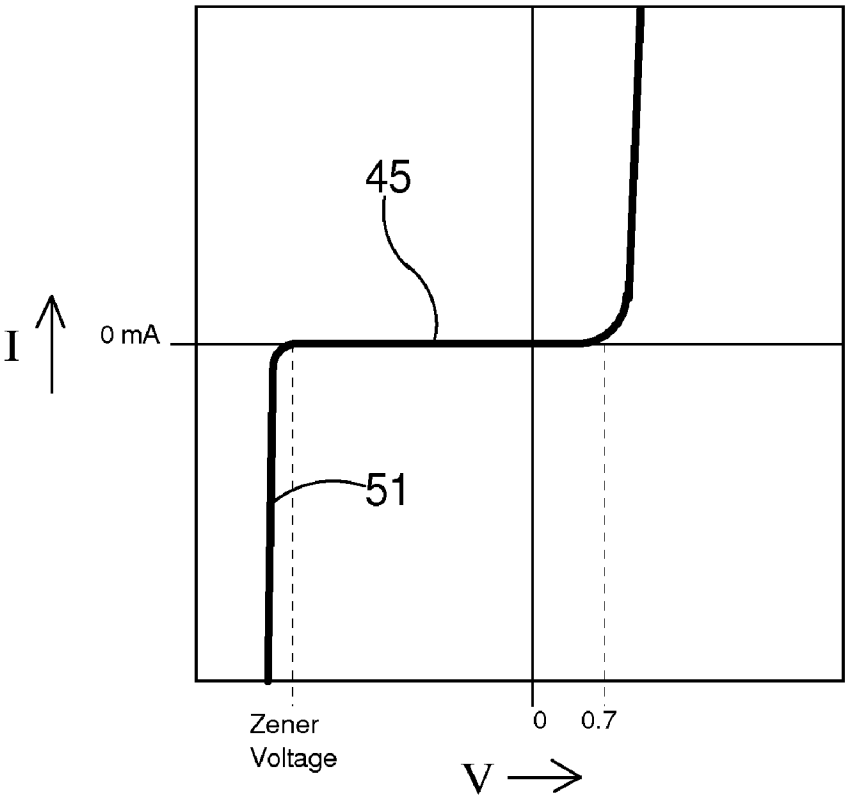
FIG. 5*b* is an IV characteristic of a Zener diode of the circuit of FIG. 5*a;*
Figure 5C:
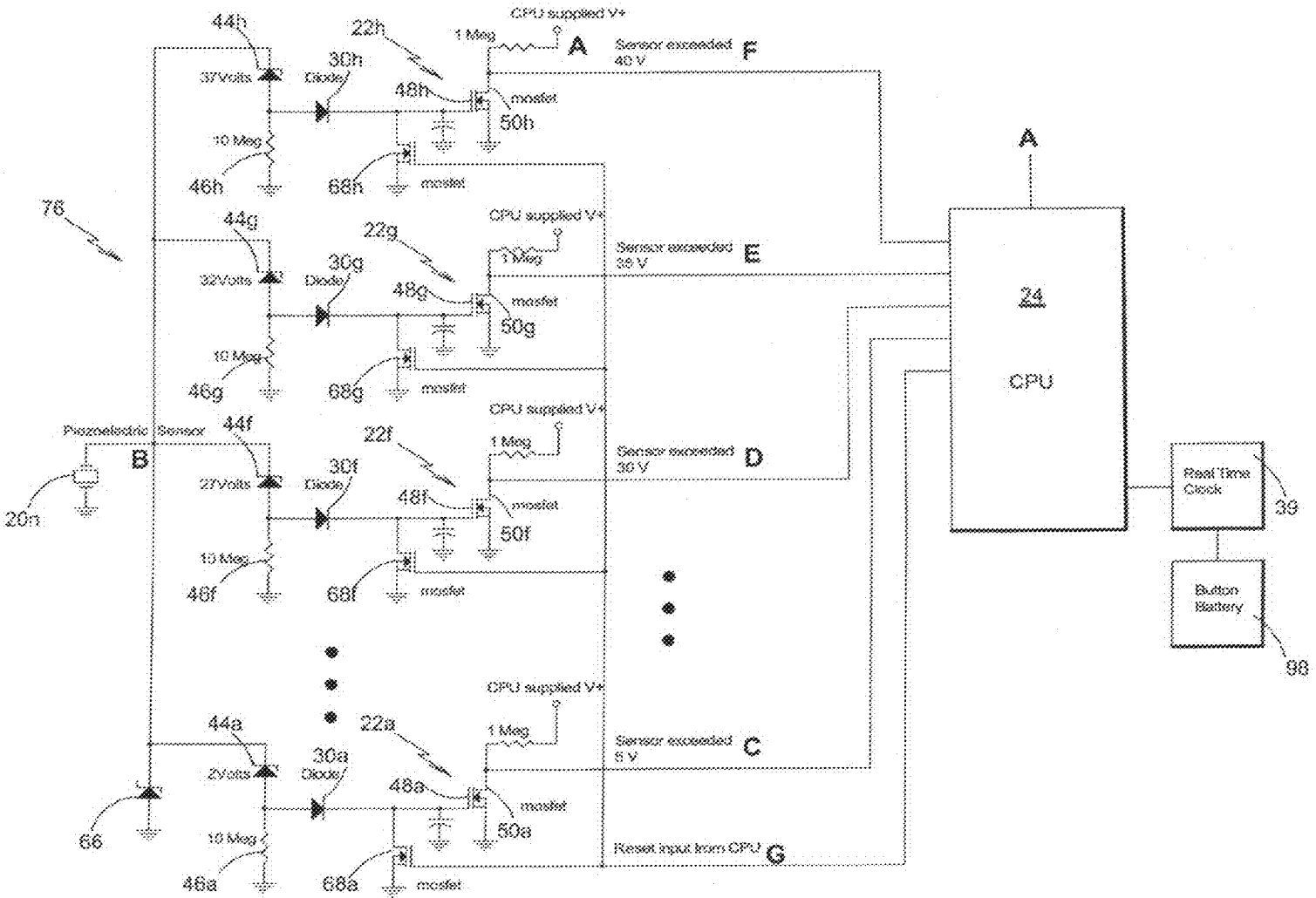
FIGS. 5*c* and 5*d* are schematic diagrams of a piezoelectric sensor and a group of circuits that record sensor data, use energy of the sensor to power the recording, and that provide for determining the approximate energy of the event as sensed by the sensor.

Once an event sensed by any one of the piezoelectric sensors 20*n* in array 20 has been recorded in memory 38 in self-powered event logging circuit 22, processor 24 may be awakened to read that data and take further action, as shown in FIG. 5*a*. CPU 24 may be periodically awakened by real time clock 39, as shown in FIG. 5*c*. Alternatively, after an event, a voltage level stored in memory 38 or provided at output 40 by self-powered event recording circuit 22 can be used to awaken CPU 24. CPU 24 can then poll all the outputs 40 of event recording circuit 22 to record data from all memory locations to which it is connected.

The same piezoelectric sensors in array 20 used for detection of an event can also be used to analyze structural integrity by applying the appropriate excitation pulses from CPU 24, as described in the '731 application. The excitation pulses can be applied to one of the piezoelectric sensors in array 20 at a time while others are used to sense the acoustic signal it generates in the structure. A response acoustic signal can also be received by the sensor sending out the acoustic signal. Alterations in these response signals relative to those from a known good structure can indicate the location and extent of damage. The data for the known good structure may be data earlier recorded on the same structure.

Figure 5D:
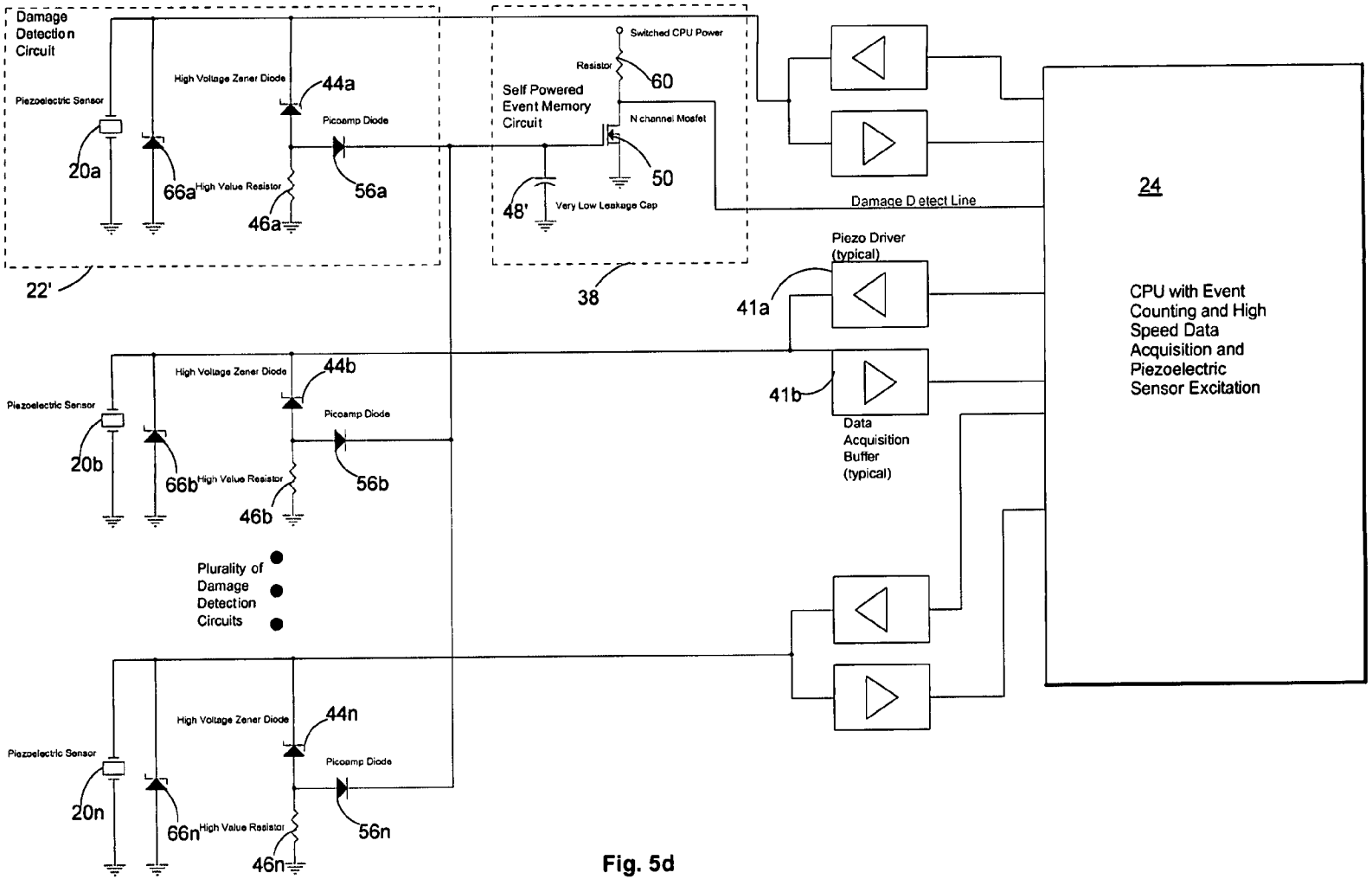

In this embodiment, array 20 of piezoelectric sensors 20*a*, 20*b* . . . 20*n* is connected to a single sensor powered event recording circuit 22', as shown in FIGS. 2*b* and 5*d*. In this embodiment if one of the sensors is close enough to the location of the event and if the event supplies sufficient energy, then the event will be stored in memory 38, as described herein above. Once such an event has been detected, the damage that may have been done to the structure can be characterized by CPU 24 sending out a pinging signal to each piezoelectric sensor 20*a*, 20*b*, . . . 20*n* sequentially through stimulus signal delivering device (SSDD) circuit 41*a*. CPU 24 then uses data acquisition circuit 41*b* to receive and record the response signal in that piezoelectric sensor or in other piezoelectric sensors of array 20.

Circuits for structural analysis, such as those described in the '731 application, use very fast microcontrollers and /or digital signal processors, which typically consume high power. Power consumption can be substantially reduced in one embodiment of the present patent application by providing that CPU 24 remain off or in sleep mode until self-powered event logging circuit 22 logs data in memory indicating an event and activates CPU 24 or until real time clock 39 activates CPU 24 to check for a signal on output 40.

A schematic diagram of self-powered event logging circuit 22*n* connected to piezoelectric sensor 20*n* of array 20 is shown in FIG. 5*a*. Piezoelectric sensor 20*n* is connected to input circuit 42 including high voltage Zener diode 44 and resistor 46.

The threshold of Zener diode 44 is selected to provide that normal non-damaging operation of a structure or normal handling, not involving firing, of a gun would not provide sufficient signal from piezoelectric sensor 220*n* to exceed that threshold and turn on Zener diode 44. Below this threshold, while Zener diode 44 is operating along region 45 of its I-V characteristic, as shown in FIG. 5*b*, leakage current is very small. The resistance value of resistor 46 is chosen to provide a very low voltage from this leakage current when piezoelectric sensor 20*n* is not providing a high enough voltage to turn on Zener diode 44. Essentially all the voltage provided by piezoelectric sensor 20*n* is dropped across Zener diode 44 until an event occurs in which piezoelectric sensor 20*n* provides a voltage exceeding the threshold of Zener diode 44. Thus, current is not provided to charge gate capacitance 48, 48', and FET 50 remains off until such an event occurs.

When an event, such as from firing a weapon or from debris hitting a structure occurs, the instantaneous voltage spike from the piezoelectric sensor may provide a much higher voltage, and Zener diode 44 may then conduct along region 51 of the I-V characteristic of FIG. 5*b*, producing a substantial voltage drop across resistor 46 and a high voltage at the anode of diode 56. Output of piezoelectric sensor 20*n* varies over the continuous range of values of the voltage spike that reaches a peak of 35 Volts, as shown by continuously varying "Piezo Sensor Signal B" in FIG. 6.

The voltage provided by piezoelectric sensor 20*n* charges gate capacitance 48 of FET 50 as well as any external capacitance 48' which may be provided in this circuit. When gate capacitance 48, 48' is sufficiently charged FET 50 turns on, connecting output 40 to ground. When CPU 24 is awakened it will provide a voltage A on line 58 connected to resistor 60 in series with FET 50.

Current will then flow though high value resistor 60 and through FET 50. CPU 24 will read a zero voltage on output 40, indicating that gate 48, 48' had stored sufficient charge to turn on FET 50 and that an event must have happened that was detected by piezoelectric sensor 20*n*, that provided a voltage exceeding the threshold of Zener diode 44, and that had enough energy to be logged in memory 38. If sufficient charge from the event is provided on capacitances 48, 48', FET 50 will turn on, electrically connecting source and drain of FET 50 and bringing the drain voltage of FET 50 at output 40 to ground. If insufficient charge is provided on capacitances 48, 48', FET 42 will not turn on and drain voltage of FET 50 at output 40 will not be connected to ground. When CPU 24 turns on it will find output 40 high. Thus, CPU 24 provides data having discrete values indicating presence of sufficient recorded voltage on capacitances 48, 48' if output 40 is at ground, as shown by "5 Volt Output C" and by "30 Volt Output D" in FIG. 6, and absence of sufficient recorded voltage on capacitances 48, 48' if output 40 is high, as shown by "35 Volt Output E" and by "40 Volt Output F" in FIG. 6, and as further described herein below.

FET 50 can be of any type, such as a MOSFET or a JFET. A MOSFET with part number 2N7002, available from Zetex, Inc., Manchester, UK, was tested, and its gate capacitance was found to store sufficient charge so an ohm meter provided from source to drain read zero ohms for more than 30 minutes. The resistance then increased to show an open circuit. Many other enhancement mode FETs have gate capacitances that have such extremely low leakage, allowing gate capacitance 48 to store the energy from the event for a similarly long period of time. This charge need only be stored on capacitance 48, 48' long enough for the CPU 24 to wake up and check the drain voltage of FET 50 at output 40. External capacitance 40*b* can be provided to increase the magnitude of this gate capacitance and the time that FET 50 is on before charge leaks away. Capacitances 48, 48' and FET 50 serve as readable memory 38, storing the information that an event occurred at piezoelectric sensor 20*n* in a form that can be read, for example, by CPU 24 connected to sense output 40.

Very low leakage diode 56 transfers charge arising from the voltage spike provided by piezoelectric sensor 20*n* to low leakage gate capacitance 48, 48', while the low reverse leakage of diode 56 preserves that charge on gate capacitances 48, 48' for a significant amount of time. A diode with part number PAD-1 available from Vishay Siliconix, Inc., Malverne, Pa., has a 45 Volt breakdown voltage and a low reverse leakage current of about 1.0 picoamperes, making it a good choice for diode 56.

Protection for the gate of FET 50 from excessive voltage can be provided by very low leakage Zener diode 66 which limits the voltage that can be provided to input circuit 42 from piezoelectric sensor 20*n* to a voltage level, such as 45 Volts. After being further reduced by Zener diode 44, and diode 56 the voltage provided to the gate of FET 50 is sufficiently reduced so gate to source voltage in FET 50 remains below a value that might produce damage.

A reset circuit can also be provided, as provided by FET 68, allowing capacitances 48, 48' to be discharged based on a signal from CPU 24 along line 49, clearing charge stored in memory 38 that may have been provided by a previous event and allowing memory 38 to be in condition to record a future event. The 2N7002 MOSFET, available from Zetex, Inc., Manchester, UK, can also be used for this purpose.

Array 76 of event logging circuits 22*a*, . . . 22*f*, 22*g*, 22*h* can be provided for each piezoelectric sensor 20*n*. Use of array 76 enables determining the magnitude of the event as measured at the location of piezoelectric sensor 20*n*. All circuits 22*a*, . . . 22*f*, 22*g*, 22*h* in array 76 receive signal from piezoelectric sensor 20*n* in parallel. In the scheme illustrated in FIG. 5*c* array 76 includes circuits that are each gated by different Zener diodes 30*a*, . . . 30*f*, 30*g*, 30*h* with turn-on voltages increasing in 5 Volt steps from circuit to circuit. Thus, the magnitude of the event can be determined in this example with 5 volt resolution. Outputs of each circuit C, . . . D, E, and F are provided to input pins of CPU 24. The magnitude of an event, as measured by piezoelectric sensor 20*n*, is determined based on which memory cells 50*n* in array 76 have charge stored in capacitances 48, 48' sufficient to turn on FETs 50 and which do not have sufficient stored charge.

Figure 6:
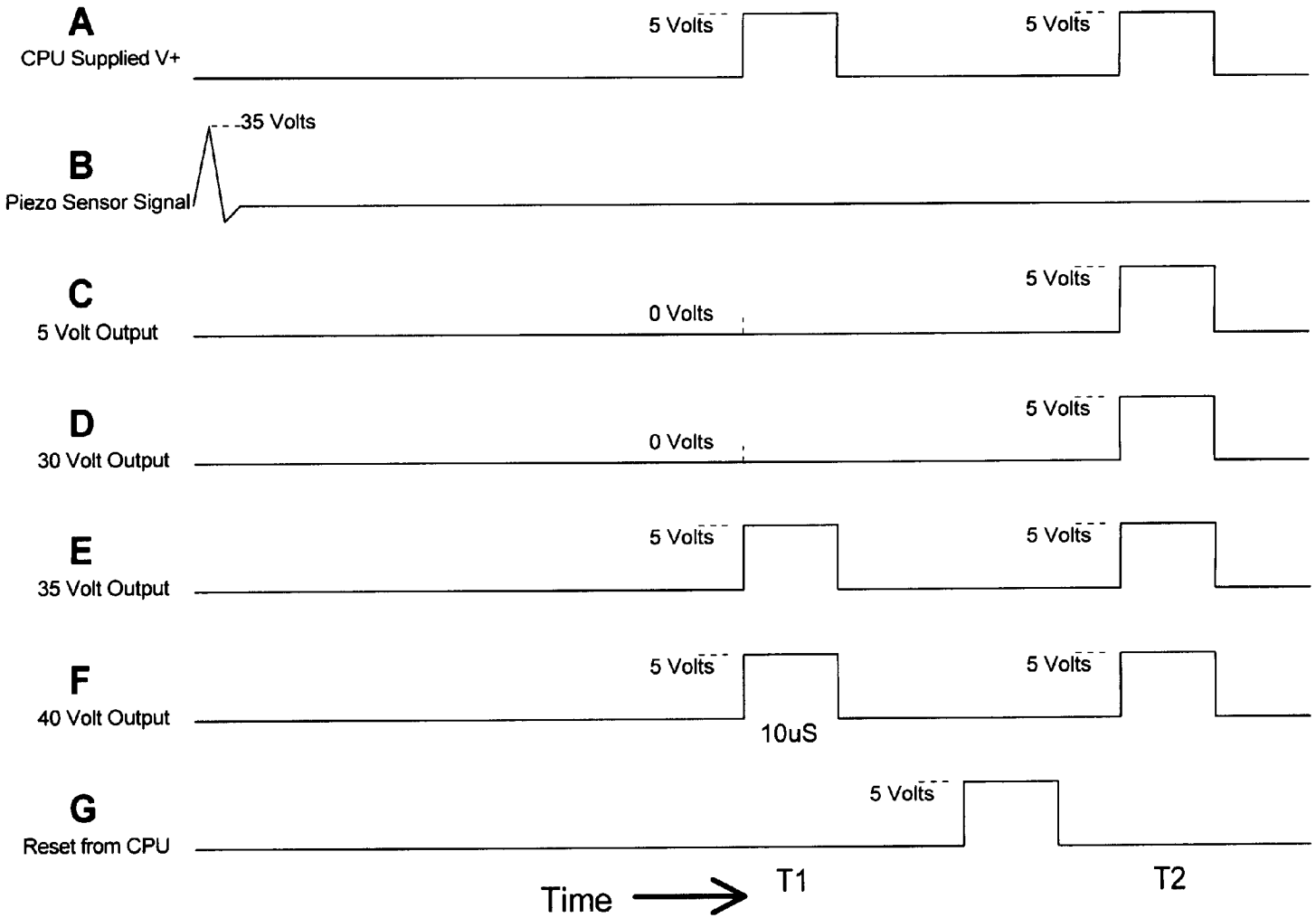
FIG. 6 is a timing diagram showing the voltages at different points in the circuits of FIG. 5 at different points in time.

Timing and voltage level diagrams, provided in FIG. 6 , further illustrate operation of event event logging circuit 76. CPU supplied voltage A is at zero volts except when CPU 24 wakes up and provides a 5 volt signal on line 58 across high value resistor 60 and FET 50. If piezoelectric sensor 20*n* receives a 35 volt signal Zener diode 66, which is set to turn on only if the voltage exceeds 45 volts, does not turn on. Thus, the 35 volt signal is applied across all 8 Zener diodes 30*a*, . . . 30*f*, 30*g*, 30*h* and their respective resistors 46. In circuit 22*a* Zener diode 30*a* turns on at 2 volts so the 35 volt signal is divided with 2 volts across Zener 30*a* and 33 volts across resistor 46*a*. The 0.7 volt drop across diode 56*a* leaves 32.3 volts on gate 48*a*, more than enough to turn on FET 50*a*, connecting output C to ground. When CPU 24 provides voltage A on line 58 equal to 5 Volts, all of this voltage is dropped across resistor 60*a* and output C remains at 0 Volts, as shown by line C at time t1. A similar analysis shows that voltage on gate 48*f* is 7.3 Volts, enough to turn on FET 50*f*, also making voltage D equal to 0 Volts.

However, voltage E remains at 5 volts because the 35 volt output of piezoelectric sensor 20*n* only provides 2.3 Volts on gate 48*g*, not enough to turn on FET 50*g*. Similarly voltage F remains at 5 volts because the 35 Volt output of piezoelectric sensor 20*n* was not enough to turn on Zener 30*h* which required 37 Volts. So no charge was stored on gate 48*h* of FET 50*h*. In the present example, CPU 24 sees that the voltage generated by piezoelectric sensor 20*n* must have been between 30 and 35 Volts to provide output D at 0 Volts and output E at 5 Volts.

Once CPU 24 has determined the magnitude of the signal provided by piezoelectric sensor 20*n*, a reset signal is sent from CPU 24 along line G, turning on all 8 reset FETs 68. This removes charge from all eight gate capacitors 48*a*-48*h*, turning all FETs 50*a*-50*h* off, so the voltage at all outputs rises to 5 volts as shown for each curve, C, D, E, and F at time t2. Now array 76 is ready to detect another event.

Of course more than the 8 circuits shown in FIG. 5*c* can be provided to either increase resolution or to extend the range of intensities of events that can be measured to a value higher than 40 Volts.

Figure 7:
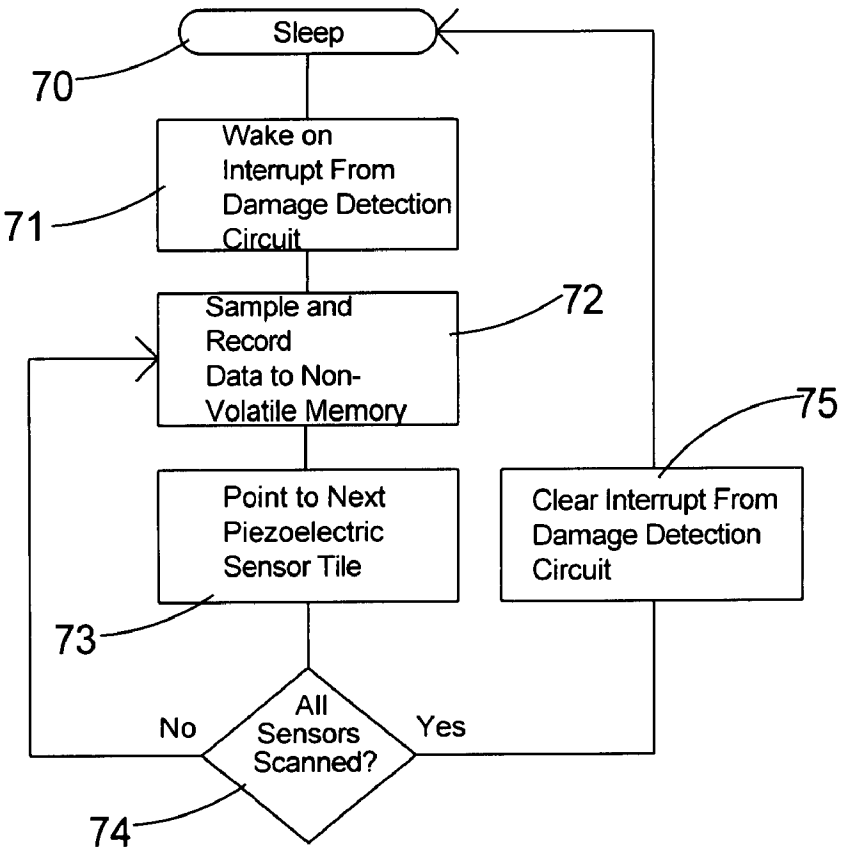
FIG. 7 is a flow chart showing the method of waking the processor when a significant event occurs, using the processor to record data in non-volatile memory, and using the processor to scan through circuits and sensors to determine whether an event happened and the magnitude of the event.

CPU 24 can be triggered to wake up and also to directly sample signals from piezoelectric sensor 20 when an interrupt signal is provided by event logging circuit 22 to an interrupt pin of CPU 24, as illustrated in the flow chart in FIG. 7. To reduce power consumption, CPU 24 may spend much of its time in sleep mode, as shown in box 70. Output 40 may be connected to a pin of CPU 24 which serves to wake CPU 24 when the voltage on output 40 descends to 0 Volts, as shown in box 71. In this event triggered mode of operation, CPU 24 provides voltage 58 to resistor 60 continuously, even while CPU is otherwise in sleep mode to maintain 5 Volts in output 40. The leakage current of MOSFET 50 in its off state is very low so this does not draw a significant amount of power until an event occurs, turning on MOSFET 50 and fully awakening CPU 24. In addition, other memory circuit arrangements can be used.

CPU 24 may determine the magnitude of signal from piezoelectric sensor 20*n* using array of circuits 76, as shown in box 72. If an array of piezoelectric sensors 20*a*, 20*b*, . . . 20*n* is provided, as shown in FIG. 1*a*, for example on a tile as shown in FIG. 2*b*, then CPU 24 can scan through each and log the magnitude of the event sensed by each piezoelectric sensor 20*n* of the array, as shown in boxes 73 and 74. Once all piezoelectric sensors 20*n* have been scanned, a signal can be sent from CPU 24 along line G as shown in FIG. 5*c* to clear the data from all memory locations so the circuits are ready to measure a subsequent event, as shown in box 75.

Figure 8:
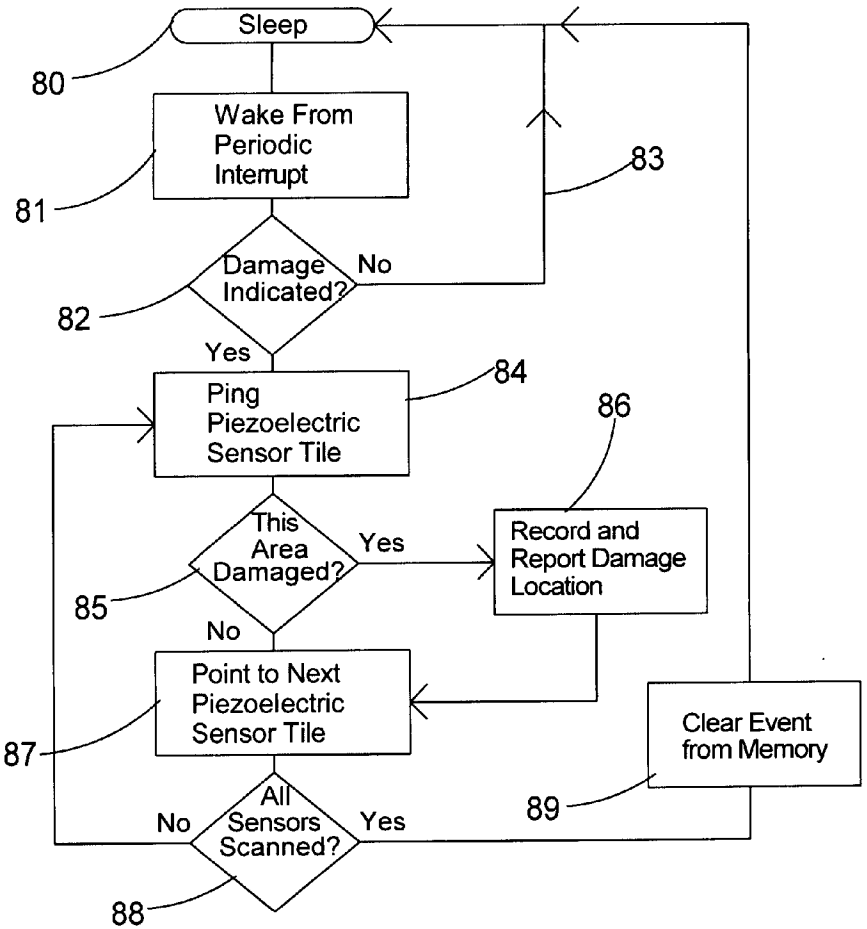
FIG. 8 is a flow chart showing the method of waking the processor based on a periodic interrupt, using the processor determine if an event occurred, record data in non-volatile memory, and using the processor to scan through circuits and sensors to determine the magnitude of the event.

Alternatively, CPU 24 can be triggered to wake up periodically, as illustrated in the flow chart in FIG. 8. CPU 24 starts in sleep mode, as shown in box 80. A periodic input, for example from a real time clock 39, can interrupt the sleep of CPU 24, waking it, as shown in box 81. Once awakened, CPU 24 provides 5 Volts on line A, as described herein above, and checks the voltage on output 40. If this voltage is high then no event was detected, and CPU 24 may go back to sleep, as shown in box 82 and line 83 extending back to box 80. If this voltage is 0 Volts, then gate 48 must be sufficiently charged to turn FET 50 on, indicating an event, which could be a damaging event, detected by piezoelectric sensor 20*n*. In the next step, a signal is provided to piezoelectric sensor 20*n*, as shown in box 84. This time piezoelectric sensor 20*n* acts as an actuator, transforming the electrical signal into an acoustic vibration, as described in the '731 application. Piezoelectric sensor 20*n* and other piezoelectric sensors now use the acoustic vibration traveling in the structure to check for and analyze the damage that was done to the structure, as shown in box 85. Data from the sensors goes back to CPU 24, as described in the '731 application. If damage is detected CPU 24 records the data, and determines the location of the damage from relative magnitudes at each piezoelectric sensor 20*n*, as shown in box 86. If no damage is detected at a particular piezoelectric sensor 20*n* then signal is provided to the next piezoelectric sensor 20*n* in array 20, as shown in box 87 and 88 and the process is repeated until all sensors have been scanned. Once all have been scanned, CPU 24 sends a signal along line G to clear memory locations so they are available to record the next event, as shown in box 89.

Figure 11A:
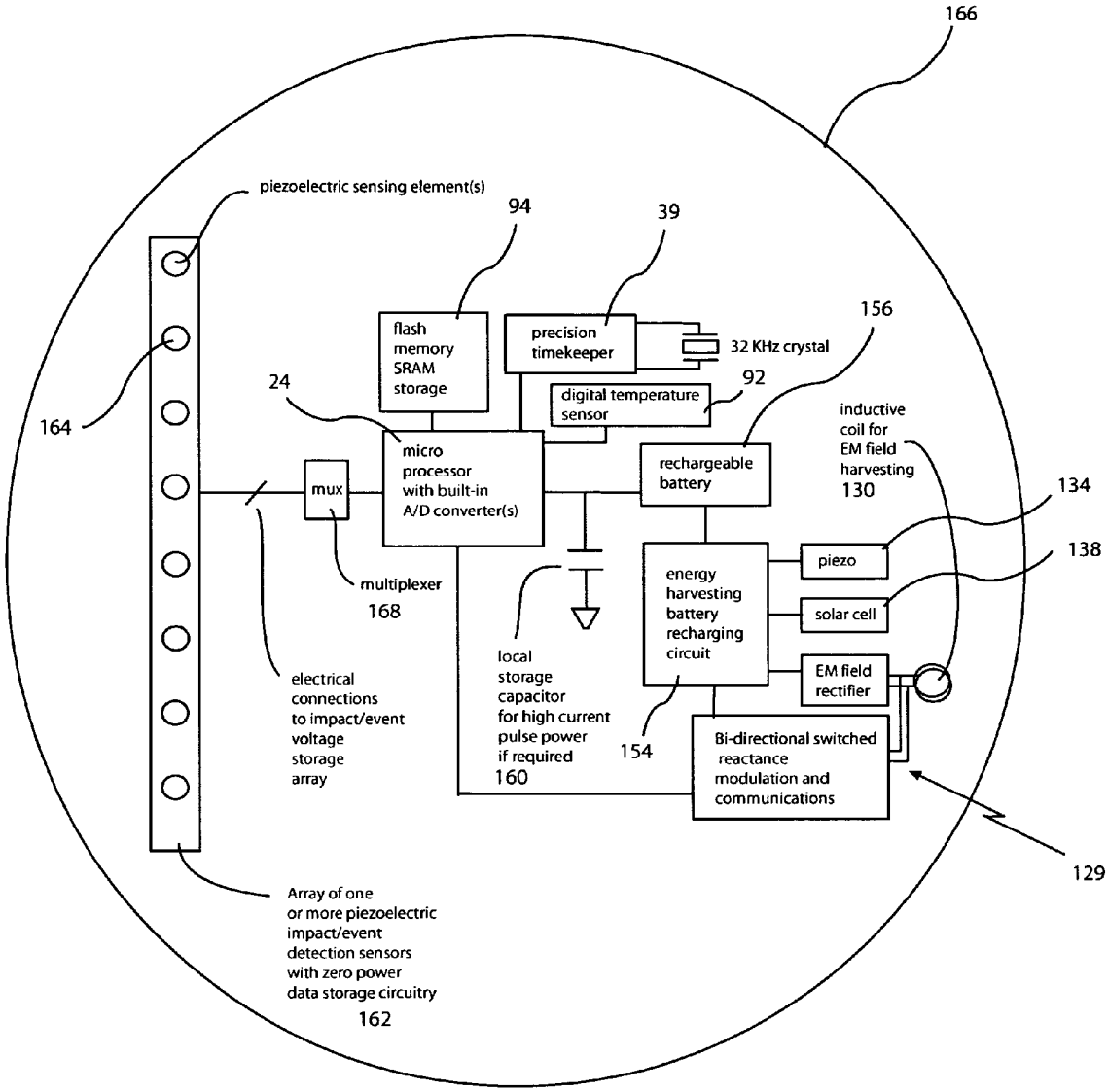
FIG. 11*a* is a block diagram of a system including an array of piezoelectric sensing elements, CPU and other circuits for analyzing the data from the array, circuits for harvesting energy for powering the CPU and other circuits, and a bidirectional switched reactance modulation and communication circuit.
Figure 11B:
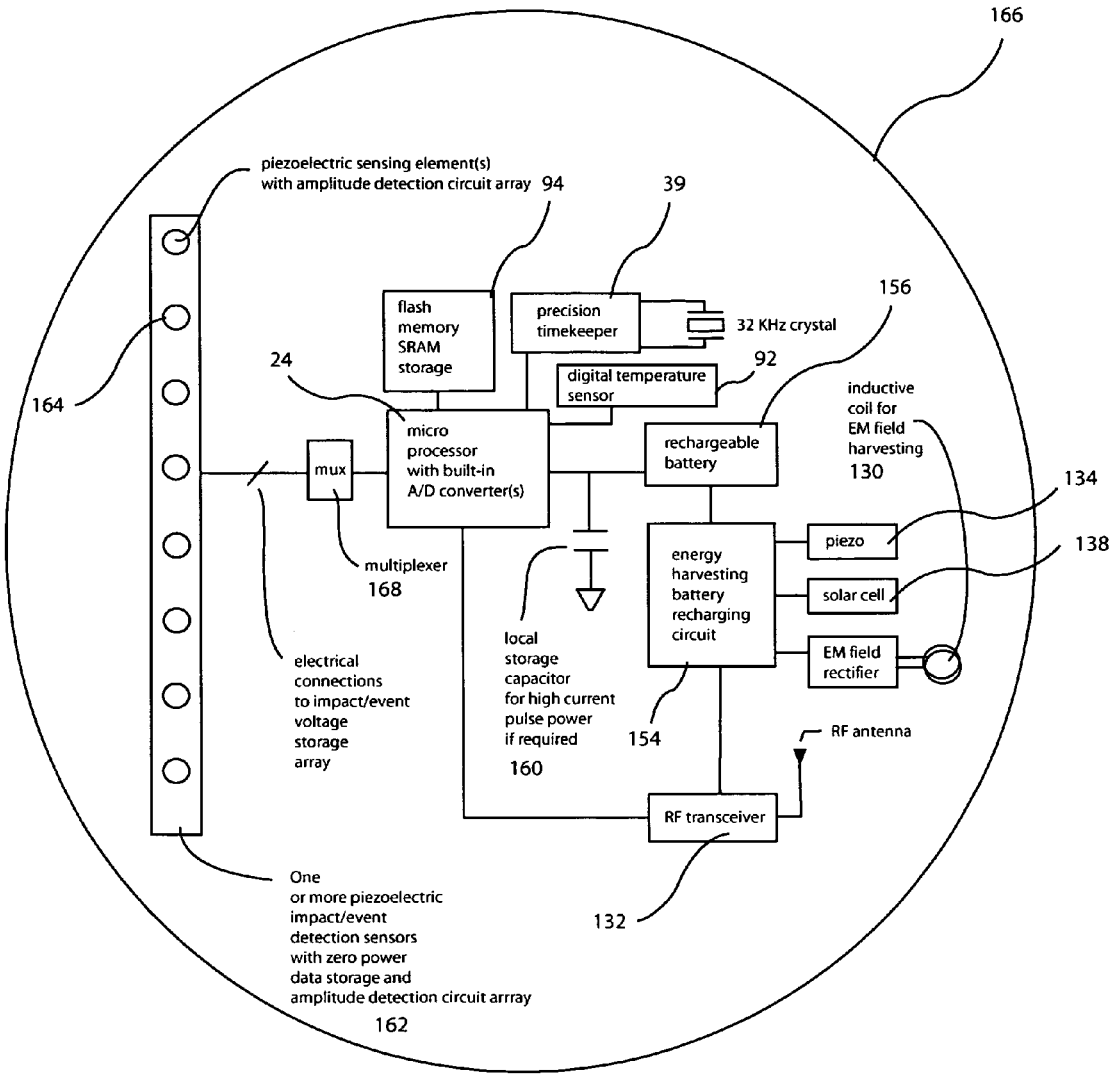
FIG. 11*b* is a block diagram of a system including an array of piezoelectric sensing elements, CPU and other circuits for analyzing the data from the array, circuits for harvesting energy for powering the CPU and other circuits, and an RF transceiver.

Once awakened, CPU 24 can check to see whether an event has been sensed by piezoelectric sensor 22*n* and stored in memory 38 as shown in FIG. 5*a*. If so CPU 24 can direct further data acquisition from piezoelectric sensor 20*n* or from other sensors in array 20, or from such other sensors as digital temperature sensor 92, as shown in FIGS. 11*a*, 11*b*. Digital temperature sensor 92 can be a TC 74, available from Microchip, Inc. If no event has been sensed, the processor may go back to sleep.

CPU 24 can also direct other operations, such as counting events and data transfer from memory 38 to a non-volatile memory, as further described herein below. CPU 24 can be connected for controlling operation of a wired or wireless communication device. The communications device can be connected for transmitting data derived from memory 38 under the control of CPU 24.

CPU 24 can also be connected for providing correction coefficients for changes in temperature and other calculations after it has been awakened and before transmission by the communications device. Based on experimentally determined coefficients stored in memory, the processor can provide compensation for drift and span errors of the sensor as temperature sensor senses changes in temperature.

Real time clock 39 can include its own energy storage device to provide it with sufficient power to keep track of time even when the energy harvesting device is not producing power and even when any energy storage device associated with the energy harvesting device has been depleted. The energy storage device can be a battery or a capacitor. It may be button battery 98, as shown in FIG. 1, and it can be non-rechargeable. This energy storage device can be connected for powering only the real time clock. Real time clock 39 is connected for providing a time stamp along with data transferred from memory 38 for longer term storage in memory device 94, as shown in FIGS. 11*a*, 11*b*. The time stamp can include both date and time.

A second energy storage device can be provided connected to the energy harvesting device which provides energy to charge the second energy storage device. The second energy storage device can include a rechargeable battery.

Figure 9:
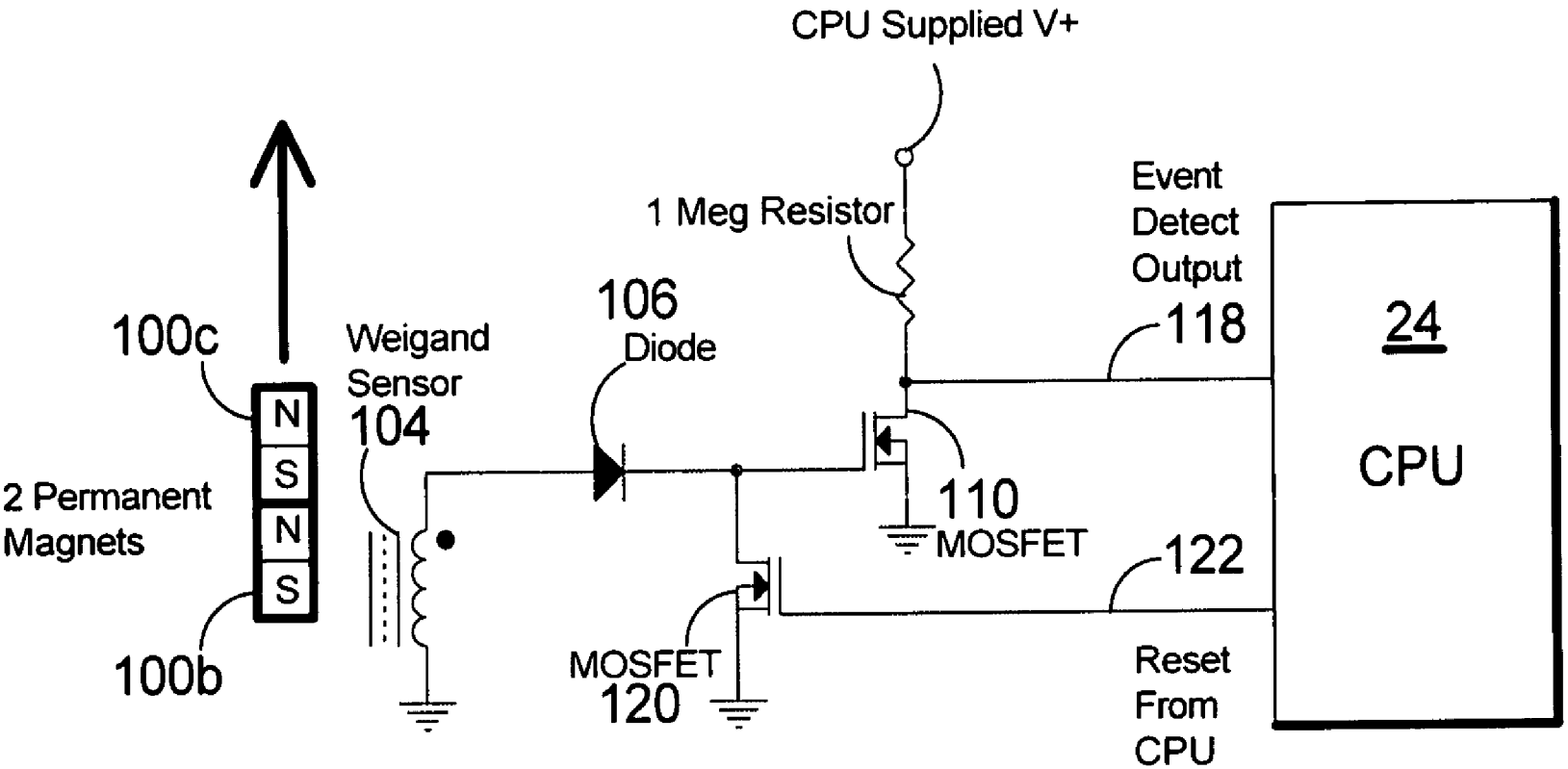
FIG. 9 is a schematic diagram of a Weigand sensor system and a circuit for record sensor data that uses energy of the sensor to power the recording.
Figure 10A:
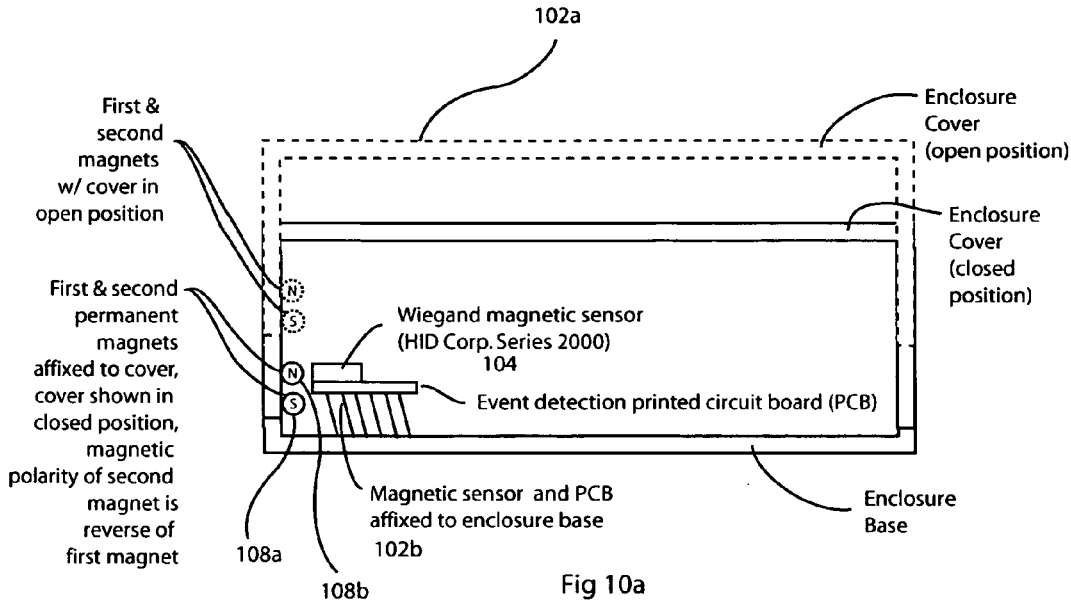
FIG. 10*a* is cross sectional diagram illustrating the use of a Weigand sensor system for determining whether a cover has been removed from a box.
Figure 10B:
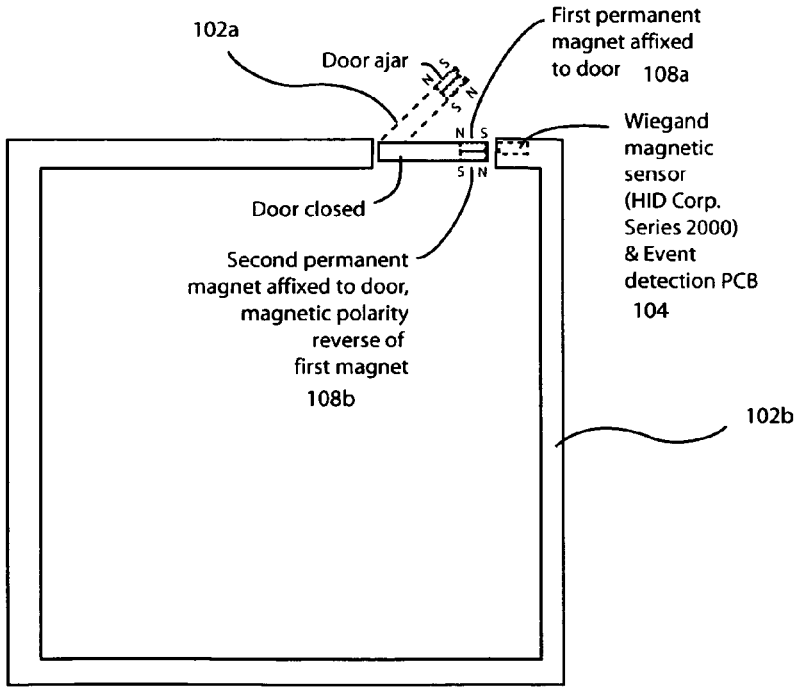
FIG. 10*b* is cross sectional diagram illustrating the use of a Weigand sensor system for determining whether a door has been opened on a container.

Other devices, such as Weigand sensors, can be used in place of piezoelectric sensors 20, as shown in FIGS. 9 and 10*a*, 10*b*. Two permanent magnets 100*a*, 100*b* with oppositely directed magnetic fields are mounted on structural element 102*a* and Weigand sensor 104 is mounted on nearby structural element 102*b* such that when relative motion is provided between structural elements 102*a* and 102*b* Weigand sensor 104 is exposed first to a magnetic field having a first polarity, for example, a north pole from permanent magnet 100*a*, and then to a magnetic field having a second oppositely directed polarity, for example, a south pole from permanent magnet 100*b*. Weigand sensor 104 outputs a voltage pulse when each magnet 100*a*, 100*b* passes, as described in a review article, "A Soft Magnetic Wire for Sensor Applications," by M. Vazquez et al, J. Phys. D: Appl. Phys. 29 (1996) 939-949 and as described in a specification for a series 2000 magnetic sensor published by HID Corporation, North Haven, Connecticut. The voltage pulse is rectified in picoamp diode 106 and is applied to gate capacitance 108 of FET 110 which provides charge storage for memory device 116. No discharge path for FET 110 gate capacitance 108 is provided so charge on gate capacitance 108 is maintained for a period of time that is a function of the magnitude of gate capacitance 108 and the magnitude of leakage current from this gate capacitance. Memory device 116 is read along output line 118 by CPU 24, as described for the circuit of FIG. 5*a*.

Alternatively, a magnetoelectric effect sensor, such as described in a paper by Ryu et al, "Magnetoelectric Effect in Composites of Magnetostrictive and Piezoelectric Materials," Journal of Electroceramics, 8, 107-119, 2002, can be used. Only one magnet is used with the magneto-electric sensor. A similar circuit to that used for the piezoelectric sensor can be used for the magneto-electric sensor.

A method of discharging gate capacitance 108 under CPU control is provided with FET 120 by applying a reset signal along line 122 to gate 124 of FET 120 from CPU 24, similar to the technique used in the circuit of FIG. 5*a*. Turning on FET 120 connects gate capacitance 108 of FET 110 to ground, discharging gate capacitance 108. Enhancement mode MOSFETs or depletion mode JFETs can be used for FETs 108, 120. Many other similar embodiments of memory device 116 are possible.

First structural element 102*a* can be a box cover, while second structural element can be mounted to the box, as shown in FIG. 10*a*. In another embodiment, first structural element 102*a* can be a door, while second structural element can be mounted to the door jamb, as shown in FIG. 10*b*.

A wired connection, such as line power or a USB connection can be used for communications and for powering CPU 24, high speed memory, such as SRAM, non-volatile memory, such as flash memory, and communications circuits. Alternatively, an energy harvesting circuit or a wireless energy receiving circuit can be used to acquire energy for CPU 24, longer term storage memory devices 94, and communications circuits, while data can be transmitted wirelessly, as shown in FIGS. 11*a*, 11*b*, and 12*a*-12*d*. freeing the circuit both from any wired connection and from the need to service batteries. Bidirectional communications can be implemented to allow, for example, for reprogramming CPU 24.

Wireless sensing system 129 with electromagnetic field powering through coil 130 and bi-directional switched reactance modulation and communication, as shown in FIG. 11*a*, was described in commonly assigned docket 115-005, incorporated herein by reference. Such a system can be embedded in tile 26 for orbiter 28, as shown in FIGS. 2*a*-2*c*. It can also be included in machine gun 29 and hand gun 30, as shown in FIGS. 3*a*-3*b* and 4*a*-4*b*. Reader 140*a* can be included in mobile robot 142*a*, as shown in FIG. 2*e*. Reader 140*b* can be included in a hand held wand 142*b*, as shown in FIGS. 2*d*, 3*b*, 4*b*, and 11*a*. Reader 140*a*, 140*b* includes battery 144, RF communications circuit 146, processor with non-volatile memory 148, oscillator 150, power amplifier 152, and inductive coil 154, for radiating power and information to coil 130 and data from coil 130 of wireless sensing system 129.

Figures 12A, 12B, 12C, 12D, 12E:
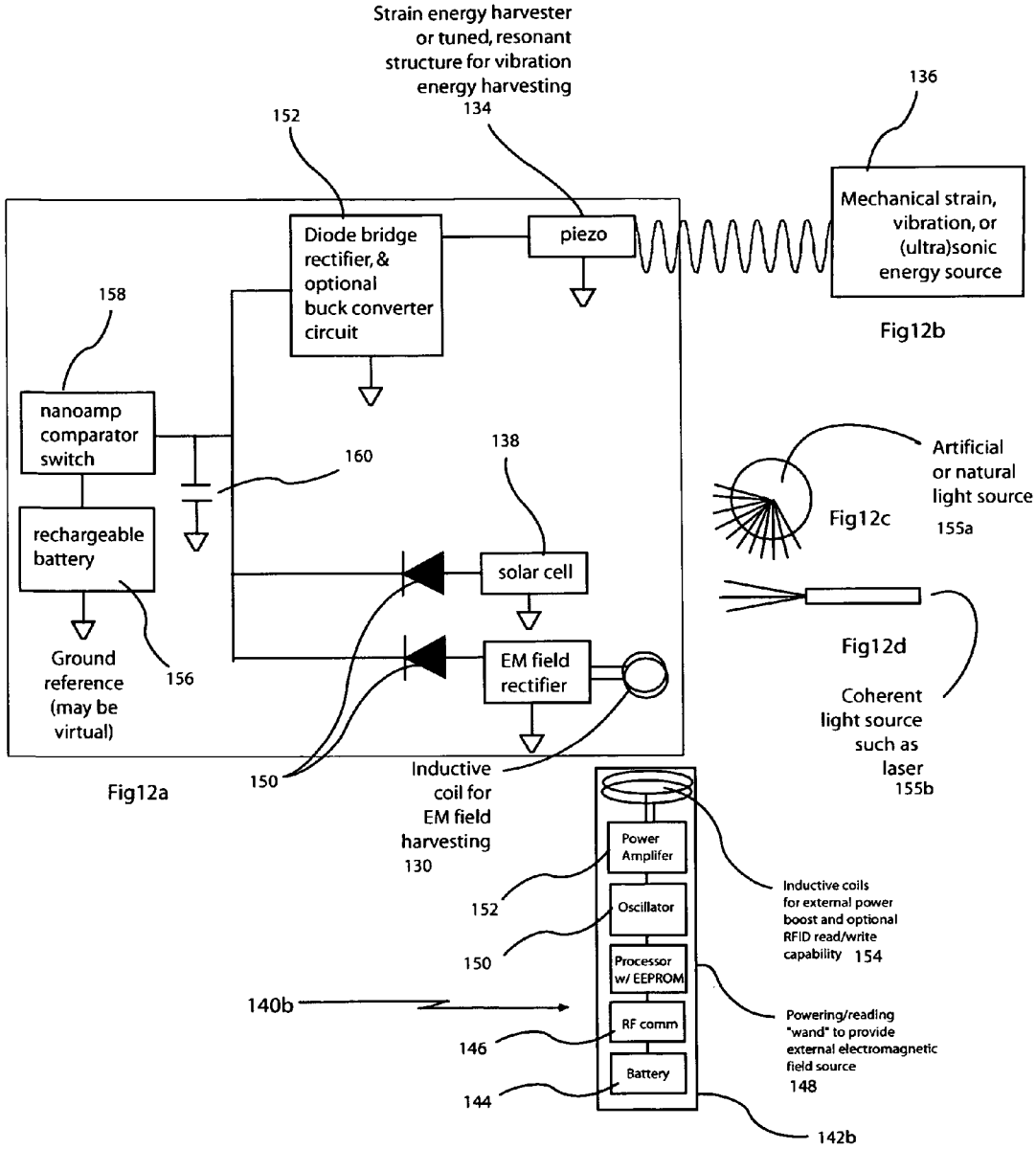
FIGS. 12*a*-12*e* are block diagrams of the portion of the system shown in FIG. ll*a* concerning harvesting energy for recharging a battery and for powering the CPU, external communications, long term memory, and other electronics as well as examples of systems, such as strain or vibration, lights, and varying electromagnetic fields, that can be used to supply that energy.

A wireless system with RF transceiver 132, as shown in FIG. 11*b*, was described in the '693 and '642 applications. Various schemes for wirelessly providing power to operate CPU 24 and communications system 130, 132 are shown in FIGS. 11*a*, 11*b*, including piezoelectric transducer 134 for harvesting ambient mechanical strain or vibration energy 136, as shown in FIG. 12*b*, solar cells 138, for harvesting natural sun light or light from a light source, such as flood lamps 155*a* or laser 155*b*, as shown in FIGS. 12*c* and 12*d*, and coil 130 for receiving electromagnetic radiation provided by reader 140*b*, as shown in FIG. 12*e*.

Any one of these or other wireless energy providing schemes can be used to provide energy for powering CPU 24 and RF transceiver 132. Two or more wireless energy providing schemes can be provided at once, each with diode 150 or diode bridge 152 to ensure that energy is used in energy harvesting and battery recharging circuit 154 to charge rechargeable energy storage device 156, which can be a capacitor or rechargeable battery, as further described in the '693 application, incorporated herein by reference. Battery recharging circuit 154 can include nanoamp comparator switch 158 and capacitor 160 to provide impedance matching, if needed, as also described in the '693 application.

Array 162 of piezoelectric sensing systems 164 are shown in system 166, illustrated in FIGS. 1*a*, 1*b*. Each piezoelectric sensing system 164 can includes array 20 of piezoelectric sensors and circuits 21, as shown in FIGS. 1, 5*a*, and 5*c*. Multiplexer 168 is used to provide sequential connection from each circuit 21 of array 162 to CPU 24.

Sensor 20*n* can include an accelerometer. In one embodiment, when the accelerometer senses an acceleration pulse, such as from the firing of a gun, memory 38 receives a signal derived from the accelerometer. CPU 24 then reads memory 38 and can accumulates a count in a second memory unit, such as an SRAM, DRAM, FRAM, or flash memory. Once awakened CPU 24 can also receive data from sensor 20*n*, as described in the '731 application and record such data as magnitude of acceleration over time, frequency components of the acoustic signal produced by the gun, time between firings, and relative magnitude of energy provided to the projectile. Piezoelectric devices can be used in accelerometers, as described in *Instrument Transducers*, by Harrnann K. P. Neubert, Second Edition, Oxford University Press, 1975 chapter 4.5 Piezoelectric transducers, pages 252-290.

Piezoelectric sensors can be mechanically tuned to various resonant frequencies in order to enhance their sensitivity to events which generate signals with those frequencies. Array of sensors 20 could include individual sensors 20*a*, 20*b*, 20*c*, . . . 20*n* tuned to a range of different frequencies to better respond to and permit characterization of particular events. Tuning can be accomplished by bonding each sensor 20*n* to a beam that is free to vibrate, as described in the '976 application, incorporated herein by reference. The beam can be tuned by adjusting position or magnitude of a proof mass vibrating with the beam. An array of such beams tuned to different frequencies can provide a high level of sensitivity to events providing a range of frequencies. U.S. Pat. No. 4,223,319 to Engdahl, incorporated herein by reference, describes a passive multielement shock recorder that includes an array of tuned seismic recording devices that use energy of a seismic event to scratch a record of the shock into metallic record plates. The present patent application also uses an array of tuned elements to provide its electronic record.

Housing 170 can be provided for containing the electronic devices of the present patent application. A circuit board (not shown) with components such as Zener diodes 44 and 66, diode 56, FETs, 50 and 68, memory 38, real time clock 39, CPU 24, longer term 5 memory storage device 94, rechargeable battery 156, energy harvesting and battery charging circuits 154, temperature sensor 92, and wireless communications device 132*a*, 132*b* can be included in housing 170. Housing 170 may be hermetically sealed. In one embodiment, the components fit in a housing that has a volume that is less than one cubic inch. Sensor 20*n* can be located within housing 170, particularly if mounted on a vibrating beam, or it can be external to housing 170 and mounted to the structure, such as the space shuttle or the gun.

The sensing node can be located on a structure that might be subject to damage from flying objects, such as the skin of an airplane, rocket, or helicopter, a helmet, or a racquet. The sensing and recording system of the present patent application is capable of using energy from the collision of the flying object with the structure to store that event. The sensing and recording system of the present patent application is capable of using energy from periodic motion, such as vibration and rotation, into electricity.

Other sensors can be included, such as a pressure sensor, a strain sensor, an orientation sensor, an accelerometer, a load sensor, a force sensor, a moisture sensor, a location sensor, such as a GPS sensor, and a magnetic field sensor. These sensors can be arranged in a Wheatstone bridge configuration. The sensor nodes can be configured in a wired or wireless communications network.

While the disclosed methods and systems have been shown and described in connection with illustrated embodiments, various changes may be made therein without departing from the spirit and scope of the invention as defined in the appended claims.

The invention claimed is:

1. A system for electronically recording data about an energy producing event, comprising an event sensing and recording node, wherein said event sensing and recording node includes an energy converting device, a first electronic memory device, and a reading circuit, wherein said energy converting device provides a first voltage, wherein said first voltage varies over a continuous range of values, wherein said energy converting device is connected to record a second voltage in said first electronic memory device when an energy producing event occurs, wherein all energy for recording said second voltage is derived from energy provided by said energy converting device, wherein said reading circuit is connected to said first electronic memory device, wherein said reading circuit is powered from a source of energy other than said energy converting device, wherein when said reading circuit is powered, data having discrete voltage values is provided in said reading circuit determined by said recorded second voltage in said first electronic memory device.

2. A system as recited in claim 1, wherein said event sensing and recording node further includes a communications circuit for communicating information about the energy producing event.

3. A system as recited in claim 2, wherein said communications circuit includes a wired communications circuit.

4. A system as recited in claim 3, wherein said wired communications circuit includes at least one from the group consisting of a USB and a CAN bus.

5. A system as recited in claim 2, wherein said communications circuit includes a wireless communications circuit.

6. A system as recited in claim 5, further comprising a reader, wherein said wireless communications circuit communicates said information to said reader.

7. A system as recited in claim 5, wherein said wireless communications circuit includes at least one from the group consisting of a switched reactance circuit and an RF transmitter.

8. A system as recited in claim 2, wherein said communications circuit is powered from a source of energy other than said energy converting device.

9. A system as recited in claim 8, wherein said reading circuit and said communications circuit are powered by at least one from the group consisting of strain, vibration, and electromagnetic radiation.

10. A system as recited in claim 9, further comprising a device for converting at least one from the group consisting of strain, vibration, and electromagnetic radiation into electricity for use in powering said reading circuit and said communications circuit.

11. A system as recited in claim 2, further comprising a housing, wherein said event sensing and recording node, and said communications circuit are included in said housing.

12. A system as recited in claim 11, wherein said housing is hermetically sealed.

13. A system as recited in claim 11, wherein said housing has a volume that is less than 1 cubic inch.

14. A system as recited in claim 11, wherein said energy converting device is external to said housing.

15. A system as recited in claim 1, further comprising an array of said event sensing and recording nodes.

16. A system as recited in claim 15, wherein each event sensing and recording node of said array comprises an energy converting device for converting mechanical energy into an analog voltage, wherein each said energy converting device is tuned to be responsive to a frequency different from other energy converting devices of said array.

17. A system as recited in claim 16, wherein said different members of said array that are tuned to be responsive to different frequencies each includes a vibrating member and a proof mass.

18. A system as recited in claim 1, wherein said event sensing and recording node further includes a reset device for automatically resetting said first electronic memory device to a discharged state.

19. A system as recited in claim 1, wherein said event sensing and recording node further includes a protect device for limiting voltage supplied to said first electronic memory device.

20. A system as recited in claim 1, wherein said reading circuit includes a processor, wherein said processor is connected to read state of said first electronic memory device.

21. A system as recited in claim 20, wherein said processor includes a sleep mode.

22. A system as recited in claim 20, further comprising a second memory device, wherein said processor is connected for transferring information from said first electronic memory device to said second memory device.

23. A system as recited in claim 22, wherein said second memory device includes at least one from the group consisting of SRAM, DRAM, and non-volatile memory.

24. A system as recited in claim 23, wherein said second memory device includes said non-volatile memory and wherein said non-volatile memory includes at least one from the group consisting of flash memory and FRAM.

25. A system as recited in claim 20, further comprising a real time clock, wherein said real time clock is connected for providing a time stamp along with information stored in said first electronic memory device.

26. A system as recited in claim 25, further comprising an energy storage device connected for exclusively powering said real time clock.

27. A system as recited in claim 25, wherein said time stamp includes date and time.

28. A system as recited in claim 25, wherein said real time clock is programmable to provide a signal at a programmably determined interval.

29. A system as recited in claim 25, wherein said real time clock is connected for providing an interrupt signal to said processor to wake said processor.

30. A system as recited in claim 29, wherein power to said processor is turned off during a portion of time between said interrupt signals.

31. A system as recited in claim 20, further comprising a second energy converting device for converting at least one from the group consisting of strain, vibration, and electromagnetic radiation into electricity, wherein said processor receives all its power derived from said second energy converting device.

32. A system as recited in claim 31, wherein said second energy converting device includes at least one from the group consisting of a coil, a solar cell, and a piezoelectric transducer.

33. A system as recited in claim 31, further comprising a rechargeable energy storage device, wherein said rechargeable energy storage device is connected for recharging from energy derived from said second energy converting device.

34. A system as recited in claim 20, wherein said processor is connected to provide compensation for data in said first electronic memory as temperature changes.

35. A system as recited in claim 20, further comprising a communications device, wherein said processor is connected for controlling operation of said communications device.

36. A system as recited in claim 35, wherein said communications device includes a wireless communications device, wherein said processor is connected for controlling operation of said wireless communications device.

37. A system as recited in claim 36, wherein said processor is connected for providing calculations for transmission by said wireless communications device.

38. A system as recited in claim 20, further comprising a network of event sensing and recording nodes, wherein each said node includes one said processor, wherein said processor includes a program to support network communications.

39. A system as recited in claim 20, further comprising a plurality of said event sensing and recording nodes and a multiplexer, wherein said multiplexer is connected to provide data derived from said plurality of event sensing and recording nodes to said processor.

40. A system as recited in claim 20, wherein said processor includes a power off mode, wherein said first electronic memory is connected to store data when said processor is in said power off mode.

41. A system as recited in claim 20, wherein said processor includes a sleep mode, wherein said first electronic memory is connected to store data when said processor is in said sleep mode.

42. A system as recited in claim 1, wherein said energy converting device comprises at least one from the group consisting of a piezoelectric sensor, a Weigand device, and a magnetoelectric effect device.

43. A system as recited in claim 1, wherein said first electronic memory device includes a capacitance and a transistor.

44. A system as recited in claim 1, wherein said event sensing and recording node includes a Zener diode electrically connected between said energy converting device and said first electronic memory device.

45. A system as recited in claim 1, wherein said reading circuit includes a processor.

46. A system as recited in claim 1, further comprising a rechargeable energy storage device and a device for converting electromagnetic radiation energy into electricity, wherein said rechargeable energy storage device is connected for recharging from energy derived from said device for converting electromagnetic radiation energy into electricity, wherein said reading circuit is connected for receiving power from said rechargeable energy storage device.

47. A system as recited in claim 1, further comprising a counter for counting events sensed by said energy converting device.

48. A system as recited in claim 1, further comprising a first structure, wherein said event sensing and recording node is mounted on said first structure, wherein said first structure includes at least one from the group consisting of a vehicle, a bridge, a building, a machine, and a weapon.

49. A system as recited in claim 48, wherein said first structure includes said weapon, and wherein said energy converting device is located within said weapon and converts energy from firing said weapon into said voltage and current.

50. A system as recited in claim 49, wherein said energy converting device comprises at least one from the group consisting of an accelerometer and a piezoelectric transducer.

51. A system as recited in claim 50, further comprising a second memory device, wherein said second memory device is arranged to accumulate a signal derived from said first electronic memory device for counting number of firings.

52. A system as recited in claim 48, wherein said first structure includes said weapon, further comprising a processor, wherein said processor is connected to determine at least one parameter from the group consisting of number of firings and time between firings.

53. A system as recited in claim 48, wherein said first structure includes said weapon, further comprising a projectile fired by said weapon, wherein said event sensing and recording node is located to convert mechanical energy from said projectile into electrical charge.

54. A system as recited in claim 53, further comprising a second structure, wherein said event sensing and recording node is located on said second structure.

55. A system as recited in claim 48, wherein said first structure includes said vehicle, and wherein said vehicle includes an aircraft.

56. A system as recited in claim 55, wherein said aircraft includes at least one from the group consisting of a helicopter, an airplane, and a space vehicle.

57. A system as recited in claim 1, wherein said energy converting device is capable of converting energy from periodic motion into electricity.

58. A system as recited in claim 57, wherein said periodic motion includes at least one motion from the group consisting of vibration and rotational motion.

59. A system as recited in claim 1, wherein said event sensing and recording node further comprises at least one sensing device from the group consisting of a temperature sensor, an accelerometer, a pressure sensor, a strain sensor, a load sensor, a force sensor, a moisture sensor, a location sensor, and a magnetic field sensor.

60. A system as recited in claim 59, further comprising a second memory device, wherein said second memory device includes configuration and calibration data for said at least one sensing devices.

61. A system as recited in claim 1, wherein said energy converting device is included in a Wheatstone bridge configuration.

62. A system as recited in claim 1, further comprising a plurality of said event sensing and recording nodes configured in a communications network.

63. A system as recited in claim 62, wherein said communications network includes a wired network.

64. A system as recited in claim 63, wherein said wired network includes a CAN bus.

65. A system as recited in claim 62, wherein said communications network includes a wireless multihop network.

66. A system as recited in claim 1, wherein said event sensing and recording node further comprises an actuator.

67. A system as recited in claim 66, wherein said actuator includes a piezoelectric transducer.

68. A system as recited in claim 66, further comprising a structure, wherein said event sensing and recording node is mounted on said structure, wherein said actuator is connected for providing a signal to said structure for material testing said structure.

69. A system as recited in claim 1, wherein said first electronic memory has a capacitance on the order of a MOSFET gate capacitance.

70. A system as recited in claim 67, further comprising at least one from the group consisting of a processor and a communications device powered by said energy harvesting device.

71. A system as recited in claim 1, wherein said reading device is powered by a source of energy other than said energy converting device.

72. A system as recited in claim 1, wherein said event sensing and recording node includes a plurality of said first electronic memory devices arranged to record magnitude of the event, wherein said reading circuit is connected to read said plurality of first electronic memory devices and to determine magnitude of the event.

73. A system as recited in claim 72, wherein said event sensing and recording node includes a plurality of said first electronic memory devices arranged to record magnitude of the event, further comprising recording said second voltage in said plurality of first electronic memory devices, reading said plurality of first electronic memory devices, and determining magnitude of the event.

74. A system as recited in claim 73, wherein said plurality of first electronic memory devices are connected to said energy converting device through threshold setting circuits, one threshold setting circuit for each first electronic memory device, wherein each threshold setting circuit sets a different threshold, wherein said determining magnitude of the event is based on at least one from the group consisting of which of said plurality of first electronic memory devices have charge stored and which of said plurality of first electronic memory devices do not have sufficient stored charge.

75. A system as recited in claim 74, wherein said threshold setting circuits are Zener diodes, wherein each said Zener diode has a different turn-on voltage.

76. A system, comprising a sensor, an energy harvesting device, a first load, and a reading circuit, wherein said sensor includes a device for converting mechanical energy into electricity, wherein said energy harvesting device includes a device for converting electromagnetic radiation energy into electricity, wherein said first load includes a first electronic memory device, wherein said device for converting mechanical energy into electricity provides a first voltage, wherein said first voltage varies over a continuous range of values, wherein said device for converting mechanical energy into electricity is connected to record a second voltage in said first electronic memory device when an energy producing event occurs, wherein all energy for recording said second voltage is derived from energy provided by said energy converting device, and wherein said reading circuit is connected to be powered from electricity derived by said energy harvesting device from said electromagnetic radiation energy, wherein said reading circuit is connected to said first electronic memory device, wherein when said reading circuit is powered, data having discrete voltage values is provided in said reading circuit determined by said recorded second voltage.

77. A system as recited in claim 1, further comprising a resetting device to remove charge stored in said first electronic memory.

78. A system as recited in claim 76, wherein said sensor includes a piezoelectric transducer.

79. A system as recited in claim 76, wherein said sensor is capable of converting energy of an impact into electricity.

80. A system as recited in claim 79, further comprising a weapon, wherein said impact arises as a result of firing said weapon, wherein said sensor converts energy resulting from firing said weapon into electricity.

81. A system as recited in claim 80, wherein said sensor is mounted to said weapon and wherein said impact arises within said weapon.

82. A system as recited in claim 80, further comprising a projectile and a substrate, wherein said projectile is fired by said weapon, wherein said sensor is mounted to said substrate, and wherein said impact arises from a collision of said projectile with said substrate.

83. A system as recited in claim 76, wherein said energy harvesting device includes at least one from the group consisting of a coil and a solar cell.

84. A system as recited in claim 76, wherein said sensor converts energy from periodic motion into electricity.

85. A system as recited in claim 84, wherein said periodic motion includes at least one from the group consisting of vibration and rotational motion.

86. A system as recited in claim 76, wherein said device for converting electromagnetic radiation into electricity includes a coil.

87. A system as recited in claim 76, wherein said electromagnetic radiation includes light, wherein said device for converting electromagnetic radiation into electricity includes a photovoltaic cell.

88. A system as recited in claim 87, further comprising a source of light.

89. A system as recited in claim 76, further comprising a plurality of said first electronic memory devices arranged to record magnitude of the event, wherein said reading circuit is connected to read said plurality of first electronic memory devices and to determine magnitude of the event.

90. A system as recited in claim 89, wherein said event sensing and recording node includes a plurality of said first electronic memory devices arranged to record magnitude of the event, further comprising recording said second voltage in said plurality of first electronic memory devices, reading said plurality of first electronic memory devices, and determining magnitude of the event.

91. A system as recited in claim 90, wherein said plurality of first electronic memory devices are connected to said energy converting device through threshold setting circuits, one threshold setting circuit for each first electronic memory device, wherein each threshold setting circuit sets a different threshold, wherein said determining magnitude of the event is based on at least one from the group consisting of which of said plurality of first electronic memory devices have charge stored and which of said plurality of first electronic memory devices do not have sufficient stored charge.

92. A system as recited in claim 91, wherein said threshold setting circuits are Zener diodes, wherein each said Zener diode has a different turn-on voltage.

93. A sensing and memory device, comprising a transducer, a threshold setting circuit, a memory, and a reading circuit, wherein said transducer provides a first voltage, wherein said first voltage varies over a continuous range of values, wherein said threshold setting circuit is connected to set a voltage threshold of at least 2 volts, wherein said transducer and said memory are connected so that when a signal from said transducer exceeds said voltage threshold sufficient charge is provided by said transducer to said memory to record a second voltage in said memory, wherein all energy for recording said second voltage is derived from said transducer, wherein said reading circuit is connected to said memory, wherein said reading circuit is powered by a source other than said transducer, wherein when said reading circuit is powered, data having discrete voltage values is provided in said reading circuit determined by said recorded second voltage in said memory.

94. A sensing and memory device as recited in claim 93, wherein said memory includes a capacitance, wherein said capacitance is charged exclusively with charge derived from said transducer when said signal exceeds said voltage threshold.

95. A sensing and memory device as recited in claim 94, further comprising a transistor, wherein said transistor includes a gate and a gate capacitance wherein said memory includes said gate capacitance, wherein said reading circuit is connected for detecting charge on said gate capacitance.

96. A sensing and memory device as recited in claim 94, wherein said capacitance consists of said transistor gate capacitance.

97. A sensing and memory device as recited in claim 94, wherein said capacitance includes capacitance that is external to said transistor.

98. A sensing and memory device as recited in claim 97, wherein said capacitance includes a capacitor in parallel with said gate capacitance.

99. A sensing and memory device as recited in claim 95, wherein said transistor is a MOSFET.

100. A sensing and memory device as recited in claim 93, wherein said threshold setting circuit includes a Zener diode.

101. A sensing and memory device as recited in claim 93, wherein said reading device includes a processor connected for detecting state of said memory.

102. A sensing and memory device as recited in claim 101, further comprising a timing device, wherein said processor is connected for waking up and periodically detecting state of said memory based on a signal from said timing device.

103. A sensing and memory device as recited in claim 93, further comprising a circuit for actuating said transducer and a circuit for acquiring a signal from said transducer.

104. A sensing and memory device as recited in claim 93, further comprising a plurality of transducers connected so any of said transducers can change state of said memory.

105. A sensing and memory device as recited in claim 104, further comprising a circuit for actuating each said transducer and a circuit for acquiring a signal from each said transducer.

106. A method of sensing and recording a potentially damaging event happening to a structure, comprising:

a. providing an event sensing and recording node on the structure, wherein said event sensing and recording node includes an energy converting device, a memory, and a reading circuit, wherein said energy converting device provides a first voltage, wherein said first voltage varies over a continuous range of values, wherein said energy converting device is connected to record a second voltage in said memory when an event occurs, wherein said reading circuit is connected to said memory, wherein when said reading circuit is powered, data having discrete voltage values is provided in said reading circuit determined by said recorded second voltage;

b. sensing the event with said energy converting device and converting energy of the event into said first voltage;

c. recording said second voltage in said memory, wherein all energy for recording said second voltage in said memory is derived from energy provided by the event; and d. powering said reading circuit from a source of energy other than said energy converting device, and reading said memory to provide data having discrete voltage values in said reading circuit determined by said recorded second voltage in said memory.

107. A method as recited in claim 106, further comprising communicating data obtained by said reading circuit.

108. A method as recited in claim 107, further comprising directing inspection of the structure based on said data obtained by said reading circuit.

109. A method as recited in claim 106, wherein said event sensing and recording node includes a plurality of said memories arranged to record magnitude of the event, further comprising recording said second voltage in said plurality of memories, reading said plurality of memories, and determining magnitude of the event.

110. A method as recited in claim 109, wherein said plurality of memories are connected to said energy converting device through threshold setting circuits, one threshold setting circuit for each memory, wherein each threshold setting circuit sets a different threshold, wherein said determining magnitude of the event is based on at least one from the group consisting of which of said plurality of memories have charge stored and which of said plurality of memories do not have sufficient stored charge.

111. A method as recited in claim 110, wherein said threshold setting circuits are Zener diodes, wherein each said Zener diode has a different turn-on voltage.

112. A system for electronically recording and reading data, comprising a sensor, a memory, a power supply, and a reading circuit, wherein said sensor provides a first voltage, wherein said first voltage varies over a continuous range of values, wherein said sensor is connected to provide a second voltage to said memory, wherein all energy for providing said second voltage to said memory is derived from energy provided by said sensor, wherein said reading circuit is connected to receive power derived from said power supply, wherein said power supply is powered by a source of energy independent of said sensor, wherein said sensor is connected to provide said first voltage during a time when said reading circuit is not receiving power from said power supply, wherein said reading circuit is connected to said memory, wherein when said power supply is providing power to said reading circuit, data having discrete voltage values is provided in said reading circuit determined by said recorded second voltage across said memory.

113. A system for electronically recording an energy producing event, comprising an energy converting device, a memory and a reading circuit, wherein said energy converting device provides a first voltage, wherein said first voltage varies over a continuous range of values, wherein said energy converting device is connected to record a second voltage in said memory when an energy producing event occurs, wherein all energy for recording said second voltage is derived from energy provided by said energy converting device, wherein said reading circuit is connected to said memory, wherein when said reading circuit is powered data having discrete voltage values is provided in said reading circuit determined by said recorded second voltage in said memory, wherein all energy for operating said reading device is provided by a source of energy other than said energy converting device.

114. A method as recited in claim 113, further comprising a plurality of said memories, further comprising recording said second voltages in said plurality of memories, reading said plurality of memories, and determining magnitude of the energy producing event.

115. A method as recited in claim 114, wherein said event sensing and recording node includes a plurality of said memories arranged to record magnitude of the event, further comprising recording said second voltage in said plurality of memories, reading said plurality of memories, and determining magnitude of the event.

116. A method as recited in claim 115, wherein said plurality of memories are connected to said energy converting device through threshold setting circuits, one threshold setting circuit for each memory, wherein each threshold setting circuit sets a different threshold, wherein said determining magnitude of the event is based on said different thresholds.

117. A method as recited in claim 116, wherein said threshold setting circuits are Zener diodes, wherein each said Zener diode has a different turn-on voltage.

118. A method of measuring an energy producing event, comprising:

a) providing an energy converting device, a memory and a reading device, wherein said energy converting device is mounted to receive energy from the energy producing event, wherein said energy converting device provides a first voltage, wherein said first voltage varies over a continuous range of values, wherein the energy converting device is connected to record a second voltage in said memory when the energy producing event occurs, wherein said reading circuit is connected to said memory, wherein when said reading circuit is powered data having discrete voltage values is provided in said reading circuit determined by said recorded second voltage;

b) recording said second analog voltage from the energy producing event in said memory;

c) providing said reading device in a sleep mode while recording said second voltage in said memory, wherein all energy for said recording is derived from the energy producing event; and d) waking said reading device and providing power to said reading device, reading said memory with said reading device, and determining magnitude of the energy producing event based on said recording in said memory wherein all energy for operating said reading device is provided by a source of energy other than the energy converting device.

119. A method as recited in claim 118, further comprising providing a clock and recording time of said energy producing event.

120. A method as recited in claim 118, further comprising determining from the magnitude of the energy producing event that the event was a damaging event.

121. A method as recited in claim 118, further comprising a plurality of said memories, further comprising recording said second voltages in said plurality of memories, reading said plurality of memories, and determining magnitude of the energy producing event.

122. A method as recited in claim 121, wherein said event sensing and recording node includes a plurality of said memories arranged to record magnitude of the event, further comprising recording said second voltage in said plurality of memories, reading said plurality of memories, and determining magnitude of the event.

123. A method as recited in claim 122, wherein said plurality of memories are connected to said energy converting device through threshold setting circuits, one threshold setting circuit for each memory, wherein each threshold setting circuit sets a different threshold, wherein said determining magnitude of the event is based on said different thresholds.

124. A method as recited in claim 123, wherein said threshold setting circuits are Zener diodes, wherein each said Zener diode has a different turn-on voltage.

* * * * *